US012415673B2

(12) United States Patent
Pearce

(10) Patent No.: US 12,415,673 B2
(45) Date of Patent: Sep. 16, 2025

(54) VAPOR AND LIQUID RECOVERY TOWER

(71) Applicant: Brooks Pearce, Cypress Mill, TX (US)

(72) Inventor: Brooks Pearce, Cypress Mill, TX (US)

(73) Assignee: Maze Environmental LLC, Cypress Mill, TX (US)

( * ) Notice: Subject to any disclaimer, the term of this patent is extended or adjusted under 35 U.S.C. 154(b) by 98 days.

(21) Appl. No.: 18/119,102

(22) Filed: Mar. 8, 2023

(65) Prior Publication Data

US 2023/0286737 A1 Sep. 14, 2023

Related U.S. Application Data

(63) Continuation-in-part of application No. PCT/US2022/030744, filed on May 24, 2022, which is a continuation-in-part of application No. 17/488,819, filed on Sep. 29, 2021, now Pat. No. 11,725,152.

(60) Provisional application No. 63/196,154, filed on Jun. 2, 2021, provisional application No. 63/192,454, filed on May 24, 2021.

(51) Int. Cl.
*B65D 90/30* (2006.01)
*C10G 33/06* (2006.01)

(52) U.S. Cl.
CPC ..... *B65D 90/30* (2013.01); *C10G 33/06* (2013.01)

(58) Field of Classification Search
CPC ..... B65D 90/30; C10G 33/06
See application file for complete search history.

(56) References Cited

U.S. PATENT DOCUMENTS 2,780,304 A * 2/1957 Pew ..... C10G 33/06 208/187
3,505,194 A * 4/1970 Martin ..... C10G 33/06 204/570
2010/0307834 A1 12/2010 Largent
2016/0008742 A1 1/2016 Adler et al.
2017/0121610 A1 5/2017 Niccum et al.
2017/0369791 A1* 12/2017 Khan ..... C10G 31/08
2020/0165528 A1 5/2020 Nanda et al.

OTHER PUBLICATIONS

PCT International Search Report for related PCT Application No. PCT/US2024/018986, dated Jul. 8, 2024, 4 pages.
PCT Written Opinion of the International Searching Authority for related PCT Application No. PCT/US2024/018986, dated Jul. 8, 2024, 5 pages.

* cited by examiner

*Primary Examiner* — Prem C Singh
*Assistant Examiner* — Juan C Valencia
(74) *Attorney, Agent, or Firm* — Shannon W. Bates; Harper & Bates LLP

(57) ABSTRACT

A vapor and liquid recovery tower (VLRT) includes a top section adapted to receive a liquid stream with entrained gas that gravity flows down through the VLRT, and a packing section comprising packing material adapted to release the entrained gas from the liquid stream to produce a VLRT liquid output and a VLRT gas output. The VLRT may further include a lower section adapted to receive a gas stream that rises up through the packing section, wherein the packing material is further adapted to increase surface area contact between the liquid stream and the gas stream, and wherein the VLRT gas output includes the entrained gas and the gas stream.

15 Claims, 33 Drawing Sheets

VAPOR AND LIQUID RECOVERY TOWER

CROSS-REFERENCE TO RELATED APPLICATIONS

This application is a continuation-in-part of PCT International Application No. PCT/US2022/030744 entitled "System and Method of Reducing Emissions and Increasing Swell in an Oil Conditioning Process" and filed on May 24, 2022, which claims the benefit of priority to: U.S. patent application Ser. No. 17/488,819 entitled "System and Method of Reducing Emissions and Increasing Swell in an Oil Conditioning Process" and filed on Sep. 29, 2021, U.S. Provisional Patent Application Ser. No. 63/196,154 entitled "System and Method of Reducing Emissions and Increasing Swell in an Oil Conditioning Process" and filed Jun. 2, 2021, and U.S. Provisional Patent Application Ser. No. 63/192,454 entitled "Crude Oil Stabilizer" and filed May 24, 2021, all of which are incorporated herein by reference.

BACKGROUND

The present invention relates to oil and gas production, and more particularly to technology for conditioning or stabilization of live crude oils at the outlet of the extraction well.

The output of oil and gas well-heads typically includes oil, water, and gas, often in an emulsion, at pressures between approximately 150 PSI and 1,500 PSI (10 and 100 bars). The process partial distillation of live crude oil and reducing the well-head pressure according to API standards is referred to as stabilization.

In a typical stabilization process, illustrated in FIG. 1A, a live crude oil stream 1320 (including oil, gas, and water) from a wellhead 1220 first goes to a separator 1230. The separator 1230 reduces the pressure of the live crude oil stream 1320 and outputs an oil stream 1332, a gas stream 1334, and a water stream 1336. Among the output streams from the separator 1230, gas 1334 released from emulsion can go directly to sale, water 1336 removed from the bottom can go to a storage and/or treatment facility, and oil stream 1332 can go to a tank 1235 for holding for additional stabilization, as oil stream 1332 typically contains light hydrocarbons and water and is at higher than atmospheric pressure, after processing only by the separator 1230.

In many conventional systems (FIG. 1A), oil stream 1332 is pumped from the tank 1235 into a heater treater 1240, which typically outputs an oil stream 1342, a gas stream 1334, and a water stream (not shown in FIG. 1A). Gas stream 1334 can go to a vapor recovery compressor 1260 or like device, as gas is moved for sale. Oil stream 1342 can go to a stabilizer tower 1250, which can output a gas stream 1354 and an oil stream 1352. Gas stream 1354 can go to a vapor recovery compressor 1260 or like device, as gas stream 1354 is moved for sale. Oil stream 1352 is stabilized to the degree that is can be stored in a conventional stabilized crude oil tank 1265 at or near atmospheric pressure. Each of the prior art components are explained below.

In general, a separator is a pressure vessel that, in a two-phase unit, receives a process flow for a retention time that allows lighter hydrocarbons to escape from the flow stream as a gas. In a three-phase separator, water also settles out from the oil for removal beneath the oil outlet of the separator. A separator generally includes internal portions or devices to promote separation, sometimes referred to as gravity settling, of the oil and water and release the gas. Often a mist extractor is used to remove liquid droplets from the gas. A separator often includes a liquid-level controller to help control internal fluid levels and a means, such as a back-pressure valve, to control internal pressure.

Often several stages of separation are employed, depending on the particular process variables of the site, to reduce pressure in stages. The separator is sometimes referred to as a Trap, a Knockout vessel, a flash chamber, an expansion vessel, or the like. Typically, the separator 1230 is near wellhead 1220, although in some installations may be located a mile away. Many separator designs have been developed, and the explanation of separator in general and/or separator 1230 is not intended to be limiting in any way.

In general, a heater treater, such as heater treater 1240, is a 3-phase vessel that utilizes heat and mechanical separation devices for further separating the oil stream 1332 from the separator 1230 into an oil stream 1342, a gas stream 1334, and a water stream (not shown in FIG. 1A). Heater treaters typically include a degassing section, a heating section, differential oil control, and a coalescing section, although not every section is required to meet the definition of a heater treater.

Oil stream 1332 (or untreated, live oil in installations that do not have an initial separator, such as separator 1230) enters the degassing section via an inlet—often at the top of the vessel. Gases that are easily released are vented into a gas collection line that often includes a mist extractor, to produce gas stream 1334. Water within the oil stream 1332 can drop to the bottom of the vessel for removal at a water outlet. After initial degassing, the emulsion passes into a heating section, which often includes a tube-type heat exchanger heated to a temperature of approximately 100 to 160 degrees F. Some heater treaters have a section containing a filtering medium to screen solid particles out of the oil. This process of heating the crude at this stage decreases the oil viscosity and promotes separation of the oil and water.

In some embodiments, a heater treater includes a coalescing section that can include a spreader and an electrostatic device that passes alternating current through the emulsion to promote formation of water droplets, which promotes separation of the water droplets by gravity. The remaining "dry" oil can be removed from the heater treater by an oil outlet at an appropriate location on the heater treater unit.

Many heater treater designs have been developed, including vertical and horizontal configurations, the choice of which depends on the particular desired parameters, such as design throughput, cycle time, and like factors.

Upon exiting the heater treater 1240, the oil stream 1342 can go to a stabilizer tower 1250. In general, a stabilizer tower, such as stabilizer tower 1250, typically includes trays, structured packing, and/or random packing in a column to promote contact between the vapor and liquid phases, permitting the transfer of mass and heat from one phase to the other. The trays have orifices for dispersing the gas uniformly on the tray and through the liquid on the tray. Types of trays include valve, bubble cap, and perforated-types. Structured packing often includes perforated plates that are folded and/or welded together. Random packing is available in many sizes and geometric shapes.

Partial fractionation or distillation of the oil often occurs in the stabilizer tower. The heavier components and higher hydrocarbons flow through the column as liquid. Some of the liquid from the bottom of the column is withdrawn and circulated through a reboiler in some configurations to add heat to the process. In the reboiler, the lighter components are driven off as a gas. At each tray or stage the rising gas performs a stripping operation such that the lighter components in the gas increase as the gas rises through the column. Pressure inside the stabilizer column can range typically between 0 to 20 PSIG (0 to 1.4 bars). Other configurations, such as a reflux system, additional heat exchangers, and like equipment and processing may be included.

The stabilized oil stream 1352, often comprising pentane and higher hydrocarbons (C5+), exits the base of stabilizer tower 1250. Oil stream 1352 may then be stored in tank 1265 at or near atmospheric pressure for eventual transport to an oil refinery or like user.

The term "swell" is often used to refer to the increase in volume of an in-ground reservoir fluid (that is, in-ground), which includes oil, when solvent molecules dissolve in the reservoir fluid. In this regard, reservoir oil swell can enhance recovery of oil trapped in inaccessible pore spaces. This specification uses the term "swell," also referred to as "uplift," to refer to the volumetric expansion of an oil stream flow rate during processing.

SUMMARY

In various implementations, a system and method for conditioning live crude oil decreases fugitive emissions, or increases volumetric oil output, or both decreases fugitive emissions and increases volumetric oil output relative to prior art systems. A system for conditioning live crude oil can include a separator, a stabilizer tower, and a heater treater that includes feeding a heater treater output gas to the stabilizer tower.

The separator is adapted for receiving live crude oil from a wellhead and for producing a separator oil output and a separator gas output. The separator in some cases is considered part of the wellhead production facility. The stabilizer tower is adapted for (i) receiving the separator oil output and receiving a heater treater gas output and (ii) producing a stabilizer tower oil output and a stabilizer tower gas output.

The heater treater is adapted for (i) receiving the stabilizer tower oil output and (ii) producing a heater treater oil output and a heater treater gas output; wherein the heater treater gas output has a temperature that is higher than the stabilizer tower gas output and the heater treater oil output is stabilized oil. A portion of the heater treater oil output may be recycled to a heater treater inlet. The heater treater may also produce a heater treater water output. A portion of the heater treater water output may be commingled with a portion of the heater treater oil output to be recycled to a heater treater inlet.

The system for conditioning live crude oil can include a vapor recovery unit (VRU) adapted for (i) receiving the stabilizer tower gas output and (ii) producing a VRU gas output and a VRU oil output. The heater treater is adapted for receiving the VRU oil output. As an alternative, the stabilizer tower is adapted for receiving the VRU oil output. The VRU can include discrete components and/or a packaged compressor and accessory components, while still being a VRU as used herein.

The heater treater may be adapted for recirculating a recirculating portion of the heater treater oil output and/or the commingled heater treater oil output and heater treater water output into the heater treater. And the recirculating portion of the heater treater oil output may be combined with the VRU oil output upon or before entering the heater treater. The system may yield an oil volumetric production rate output (that is, stabilized oil that may be measured at a stabilized oil tank) that is greater than a volumetric production rate of the separator oil output, wherein the volumetric production rates are measured in BOPD.

The live crude oil fed to the conditioning system includes at least an oil component and a gas component, and typically also includes a water component. Thus, the components disclosed herein may be two phase or three phase components. Typically, some aspect of the system will include a water separation capability.

Hydrocarbon gas from the separator and/or from the stabilizer may be sent to at least one of a user, the stabilizer tower, and the heater treater. The stabilizer components may be pre-assembled (that is, in a fabrication facility) and mounted on a skid (that is, a unitary structural steel frame). The heater treater components may also be pre-assembled and mounted on a skid.

The process for conditioning oil, often including increasing swell or uplift, can include steps for operating the system as described (in whole or in part) herein, including providing gas from the heater treater directly to the separator. The process for conditioning live crude oil may include the steps of: receiving a live crude oil stream from a wellhead into a separator, the live crude oil stream including at least an oil component and a gas component; separating a first gas stream from the live crude oil in the separator to create at least a first oil stream; receiving the first oil stream from the separator into a stabilizer tower; separating a second gas stream from the first oil stream in the stabilizer tower to create a second oil stream; receiving the second oil stream into a heater treater; separating a third gas stream from the second oil stream in the heater treater to create a stabilized oil stream and a third oil stream, and circulating the third gas stream from the heater treater to the stabilizer wherein the third gas stream combines with the second gas stream to create a combined second gas stream, the combined second gas stream flowing to a vapor recovery compressor; moving the stabilized oil stream to a stabilized oil tank; and circulating the third oil stream within the heater treater. The stabilized oil stream has a greater volumetric flow rate, measured in BBLD, than the volumetric flow rate of the stabilizer oil input, measured in BBLD.

The process may include the step of circulating a recirculating portion of the second gas stream from the stabilizer tower to the heater treater and a conditioned portion of the second gas stream from the stabilizer tower to a user, and may include a step of circulating a recirculating portion of the VRU output gas stream to either the heater treater or stabilizer tower.

The process may include the step of flowing the stabilized oil stream to a stabilized crude oil tank that is approximately at atmospheric pressure, or the process may include the step of flowing the stabilized oil stream directly to an end user. The step of circulating the third oil stream includes inputting the third oil stream at an inlet of the heater treater.

The process may include the step of cooling the stabilized oil stream before it enters the stabilized crude oil tank. In some implementations, the step of cooling the stabilized oil stream may be used to decrease emissions.

The process for conditioning oil to decrease emissions, without increasing swell or uplift, does not require the step of combining the recirculating portion of the heater treater oil output with the VRU oil output upon or before entering the heater treater.

The word stream does not require that the process be perfectly continuous or steady state. For merely one example, dump valves may operate in the equipment such that they close temporarily in response to liquid level in a unit.

Produced oil stream 1456 will then flow into the oil storage tank 1646. Gas stream 1458 produced from the vapor recovery tower 1746 will typically be comingled with the produced gas 1334 from heater treater 1346 and will be sent to the vapor recovery compressor 1430. The vapor recovery compressor 1430 will typically control the pressure of the vapor recovery tower. The produced gas 1334 from heater treater 1346 can sometimes go straight to sales gas instead of to vapor recovery compressor 1430. Vapor recovery compressor 1430 will compress the inlet gas and add line pressure so that it may be comingled with the higher pressure gas produced from 3-phase separator 1230 and be sent to gas sales.

Figure 1A:
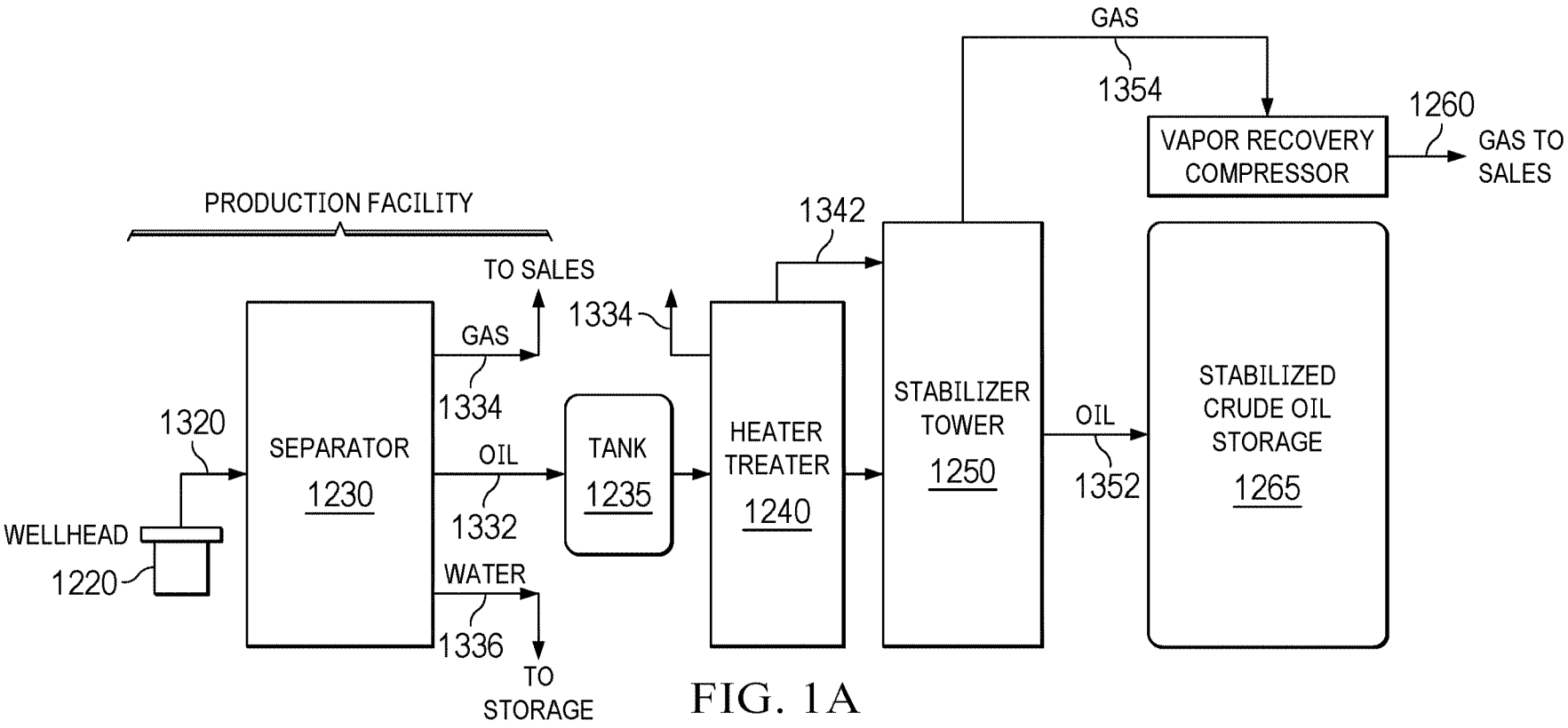
FIG. 1A (PRIOR ART)
FIG. 1A (Prior Art) is a process flow diagram of a conventional live crude oil stabilization process.
Figure 1B:
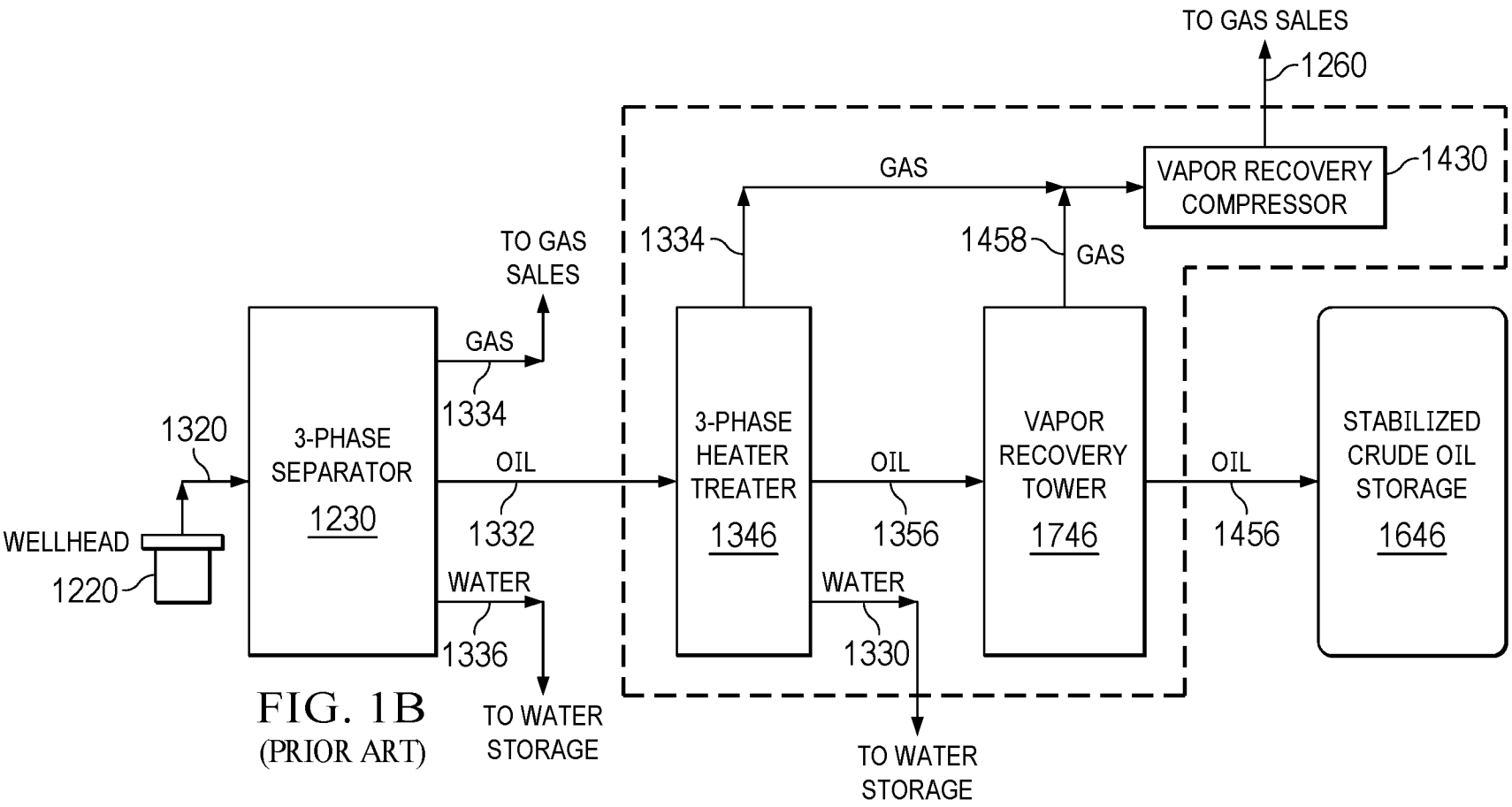
FIG. 1B (PRIOR ART)
FIG. 1B (Prior Art) shows a simple diagram of a traditional production facility using a vapor recovery tower to capture emissions off produced oil. This process describes a traditional upstream production facility process to eliminate emissions. From the wellhead, crude oil stream 1320 flows into a 3-phase separator 1230. Produced oil stream 1332 flows into a 3-phase heater treater 1346. Using applied heat and retention time, the inlet fluids to the heater treater will produce oil stream 1356, water stream 1330, and a gas stream 1334. Oil stream 1356 flows into a vapor recovery tower 1746. A vapory recovery tower is typically a 2-phase vertical tower, separating gas from oil. A vapor recovery tower can sometimes produce water. By operating the vapor recovery tower at a lower pressure than the upstream heater treater, this allows gas to separate from the inlet oil fluid. A vapor recovery tower is typically an open vessel with an internal pipe upcomer to drain oil from the bottom of the vessel into an oil storage tank. Sometimes there is a mesh pad in the tower.
Figure 1C:
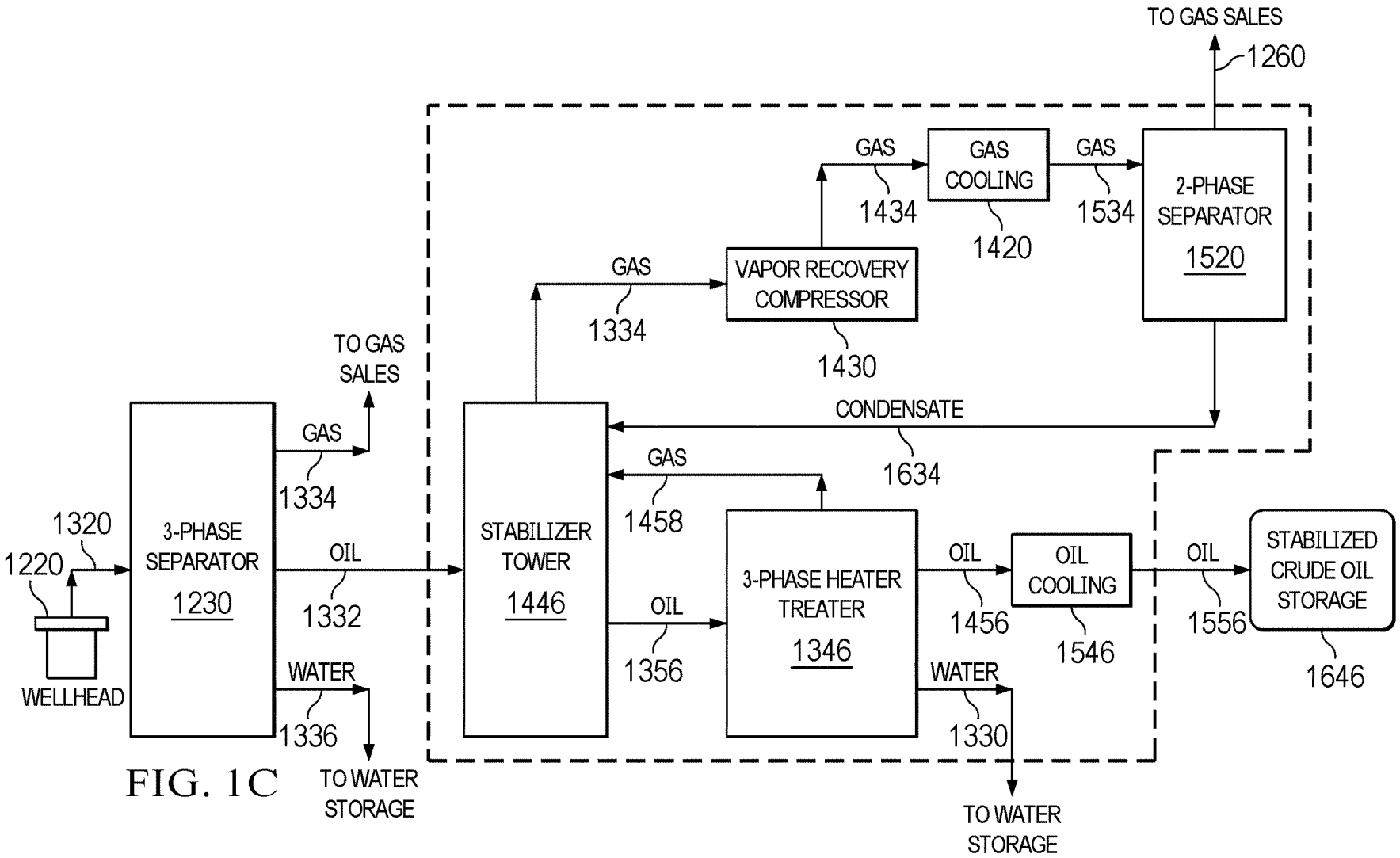

FIG. 1C shows a simple diagram of a production facility using an oil stabilization tower to capture emissions of produced oil. This figure is similar to FIG. 1B except it uses a stabilizer tower 1446 to release gas from produced oil stream 1332 by operating at low pressure.

Figure 1D:
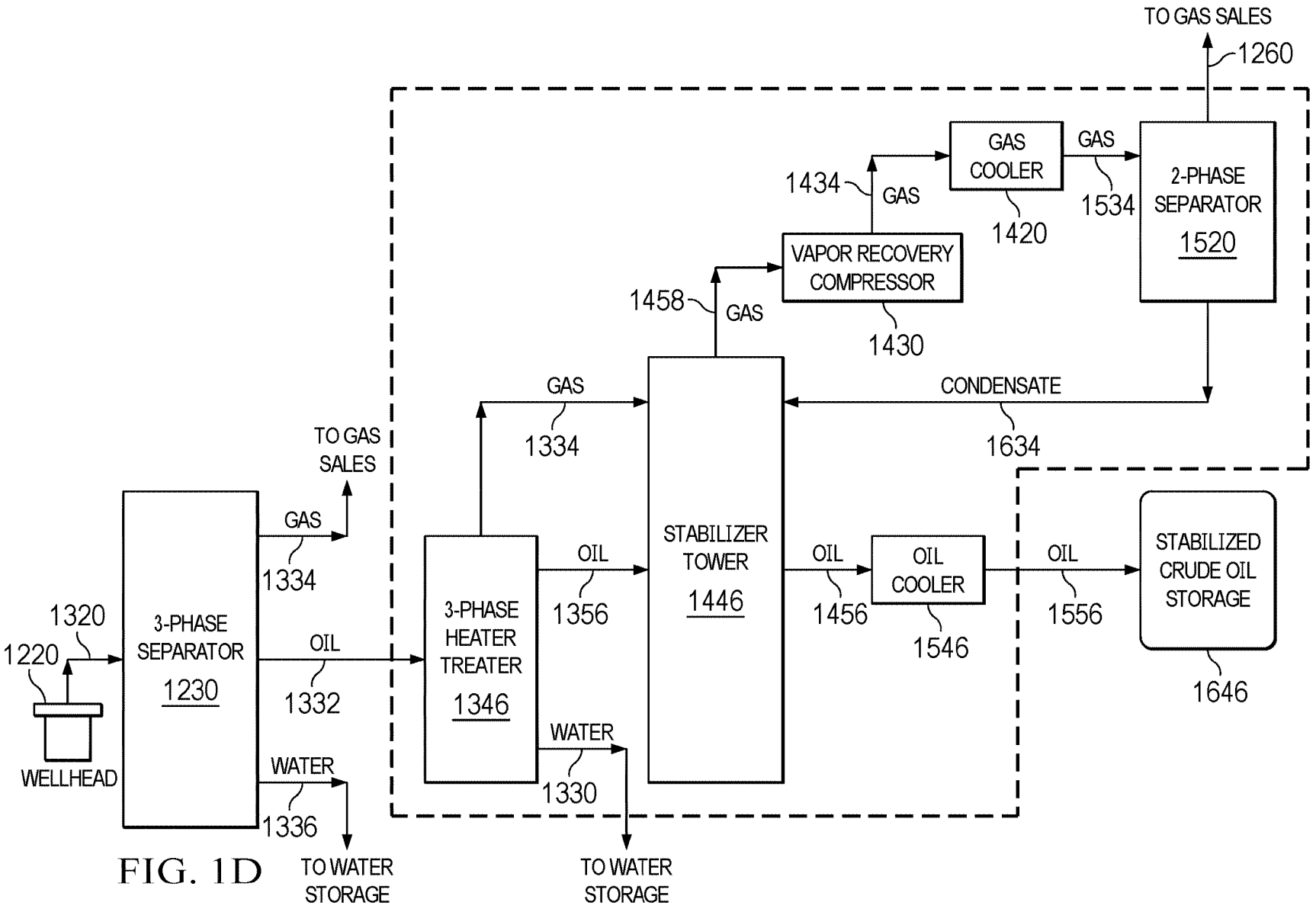

FIG. 1D shows a simple diagram of a production facility using an oil stabilization tower to capture emissions of produced oil. This figure is similar to FIG. 1C except the stabilizer tower 1446 is downstream of the heater treater 1346 and the pressure is not equalized between the two vessels. Produced oil from 3-phase separator 1230 sends oil to heater treater in stream 1332. Heater treater will operate at a pressure to send the produced oil stream 1356 to the stabilizer tower. Produced gas 1334 from the heater treater 1346 will flow to the bottom of the stabilizer tower similar to FIG. 1C. Produced oil 1456 from stabilizer tower 1446 will flow directly to oil cooling. Gas stream 1434 from the vapor recovery compressor is sent to a gas cooling process to extract liquids of the gas stream.

Figure 1E:
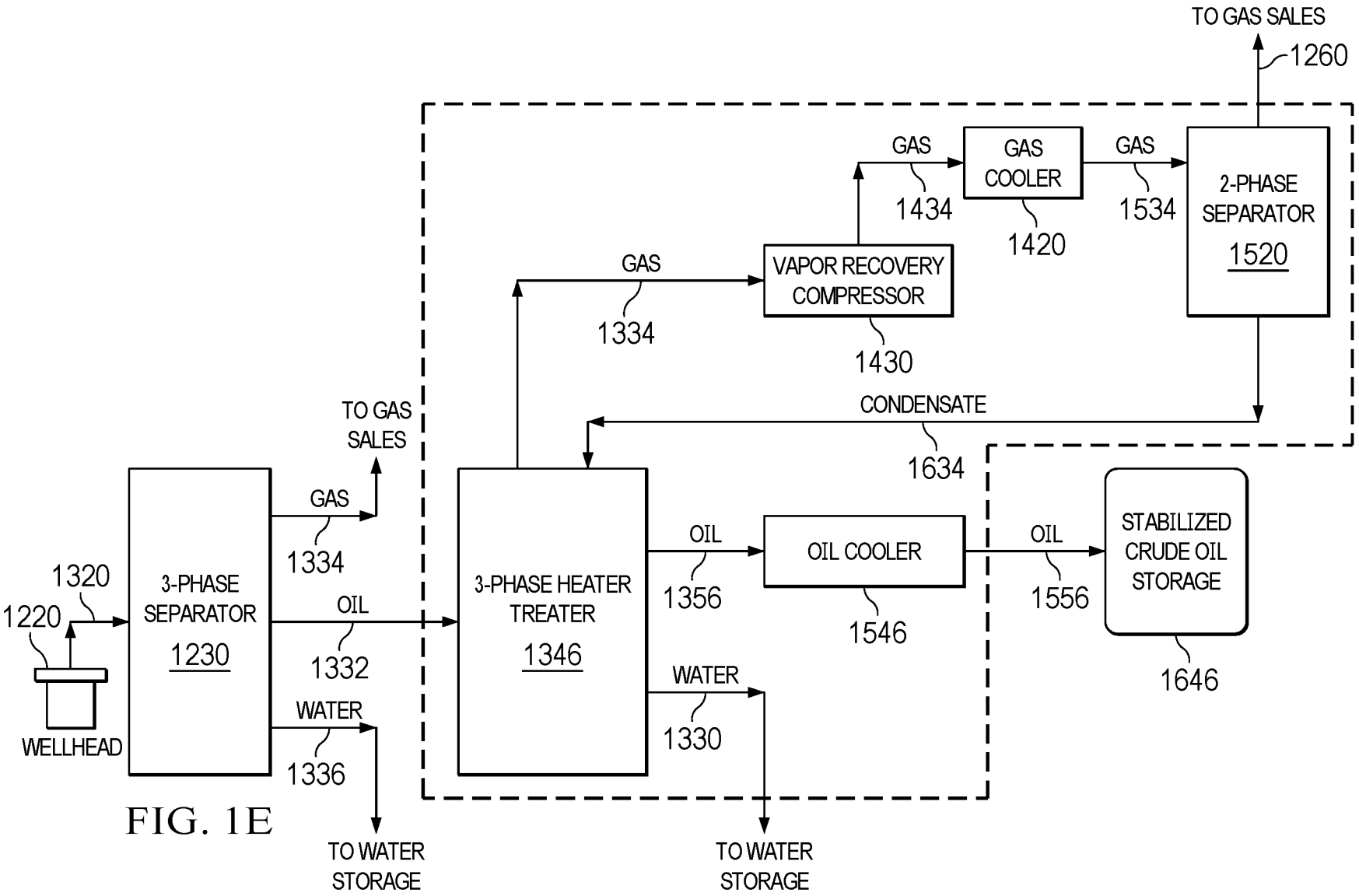

FIG. 1E shows a simple diagram of a production facility using a heater treater to capture emissions of produced oil. This figure is similar to FIG. 1D except the heater treater 1346 will act as the low pressure vessel and a stabilizer tower is not needed. Heater treater 1346 will operate at low pressure and will allow gas to separate from the oil. Produced gas in stream 1334 will go through the same liquid recovery process, compressing and cooling the gas to collect condensate. Condensate 1634 will be sent from 2-phase separator 1520 back to the heater treater. The condensate will vaporize and mix with the low pressure vapor space inside heater treater 1346 and cause heavy hydrocarbons to fall out of the gas and add swell and an uplift in oil production. Produced oil stream 1356 from heater treater 1346 will be sent to oil cooling to stabilize the oil stream before entering oil storage tank 1646.

Figure 1F:
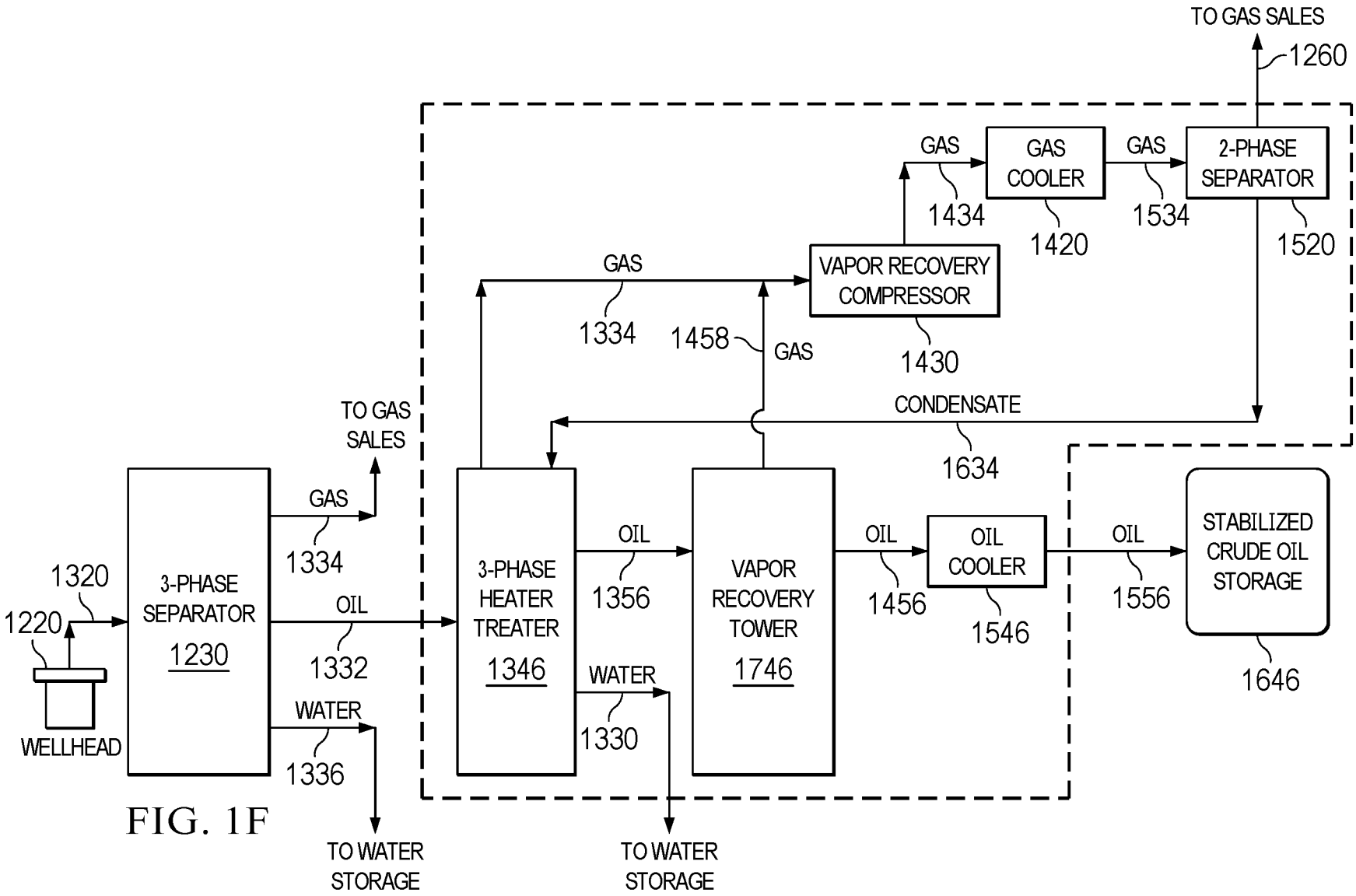

FIG. 1F shows a simple diagram of a production facility using a vapor recovery tower to capture emissions of produced oil. This figure is similar to FIG. 1D. Produced oil from 3-phase separator 1230 sends oil to heater treater in stream 1332. Heater treater will operate at a pressure to send the produced oil stream 1356 to the vapor recovery tower 1746. Produced gas from the heater treater 1346 will flow directly to the vapor recovery compressor 1430 to be compressed and cooled. Condensate 1634 produced from the 2-phase separator 1520 will be sent to the heater treater 1346 to cross exchange with the heater treater vapor space. Produced oil stream 1456 from vapor recovery tower 1746 will flow directly to oil cooling. Gas stream 1458 produced from vapor recovery tower 1746 will be comingled with gas stream 1334 from the heater treater to be sent directly to the vapor recovery compressor.

Figure 2A:
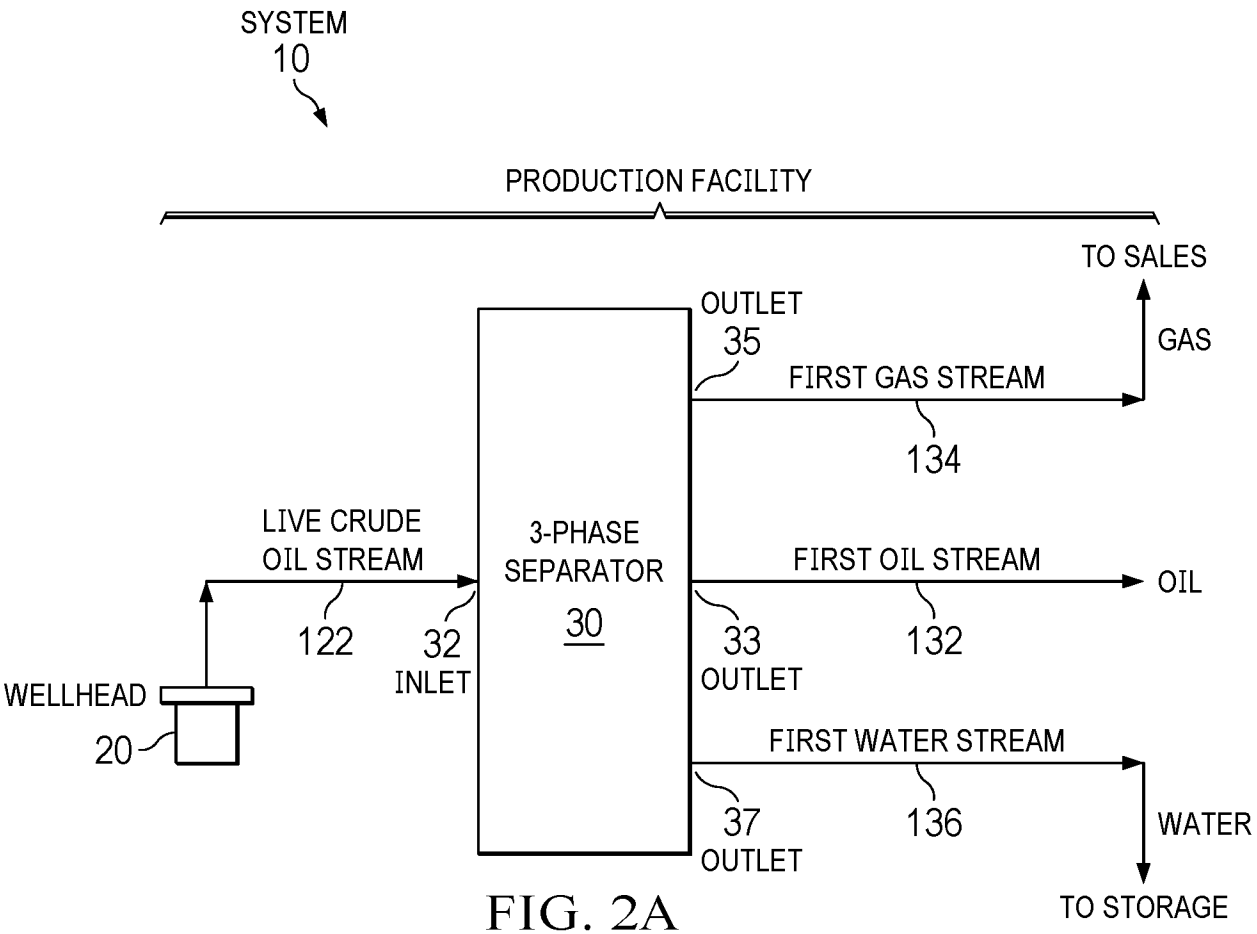

FIG. 2A is a simplified flow process diagram of a first portion of a first example of a live crude oil conditioning process using a 3-phase separator.

Figure 2B:
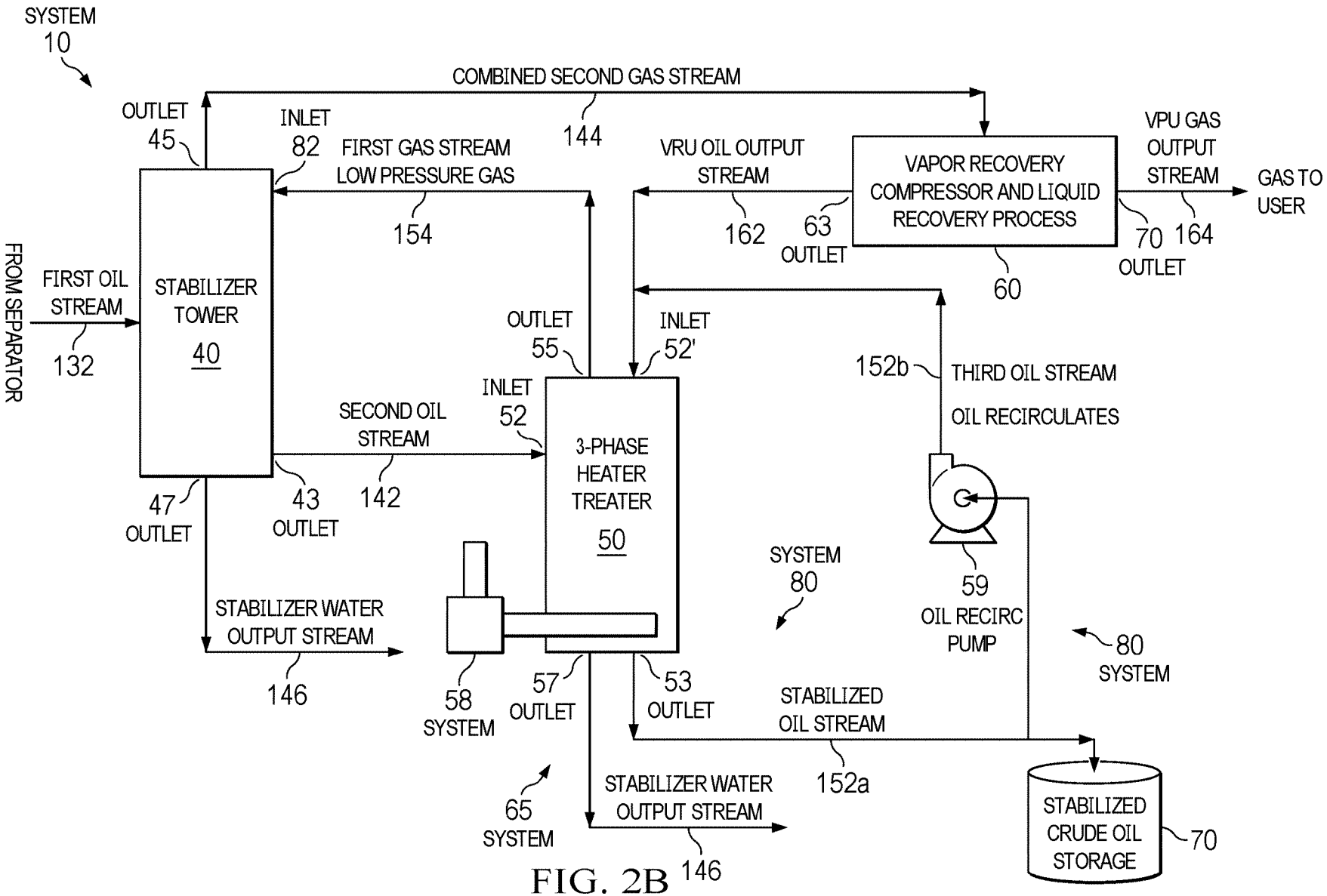

FIG. 2B is a simplified flow process diagram of a second portion, down-stream of the portion shown in FIG. 2A, of the example of a live crude oil conditioning process.

Figure 2C:
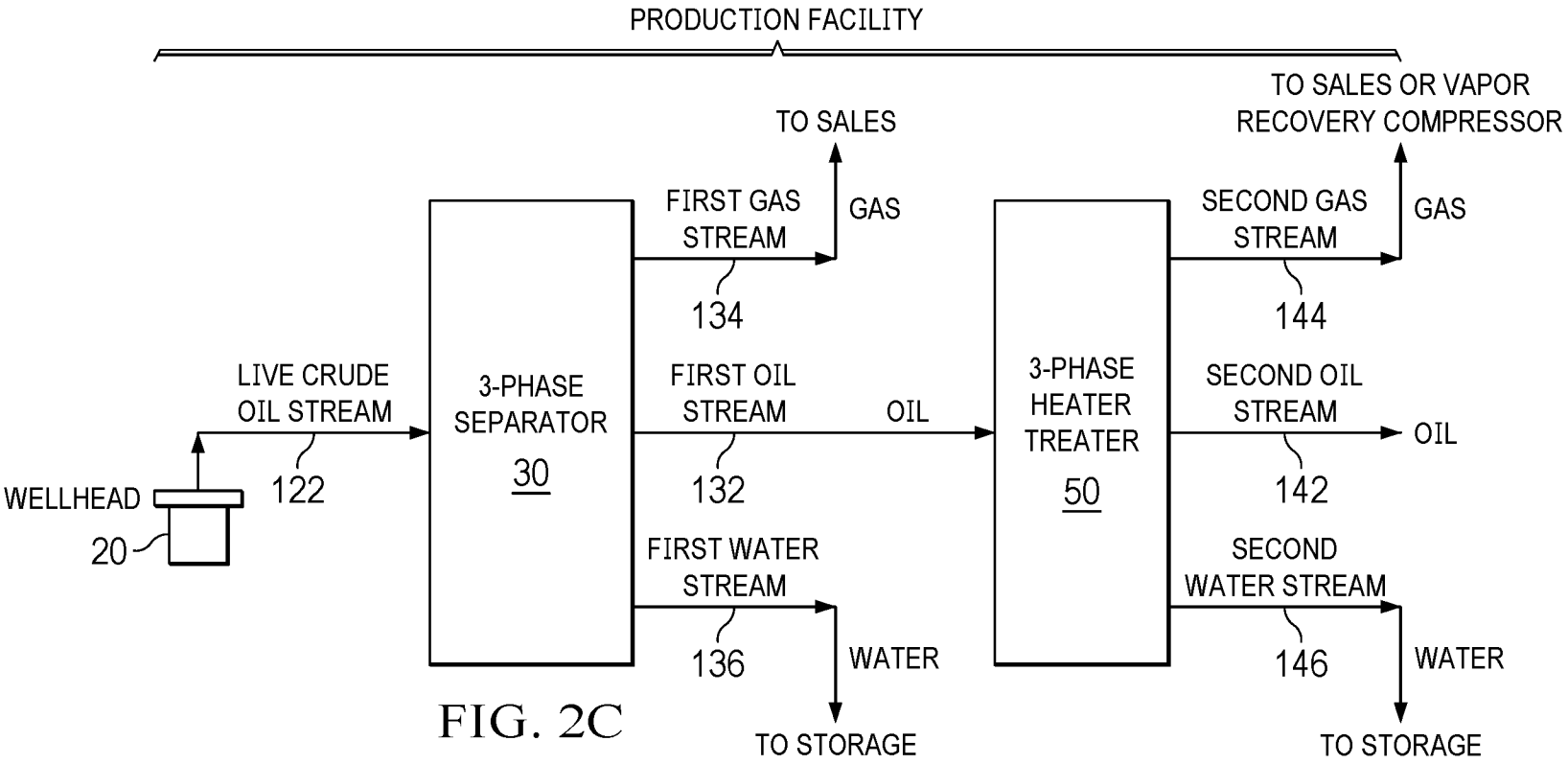

FIG. 2C shows an example for another type of a production facility. This involves a 3-phase separator that sends separator oil from the wellhead emulsion to a 3-phase heater treater. A heater treater is used as secondary treatment for the produced oil. A heater treater vessel adds heat to the fluids and gas inside and to get further separation of water and gas out of the oil. Gas from the heater treater typically comingles with the cold 3-phase separator and goes to gas sales or goes to a vapor recovery compressor to raise pipeline pressure to send gas to sales if the heater treater is not operating at a sufficient pressure to send to sales.

Figure 2D:
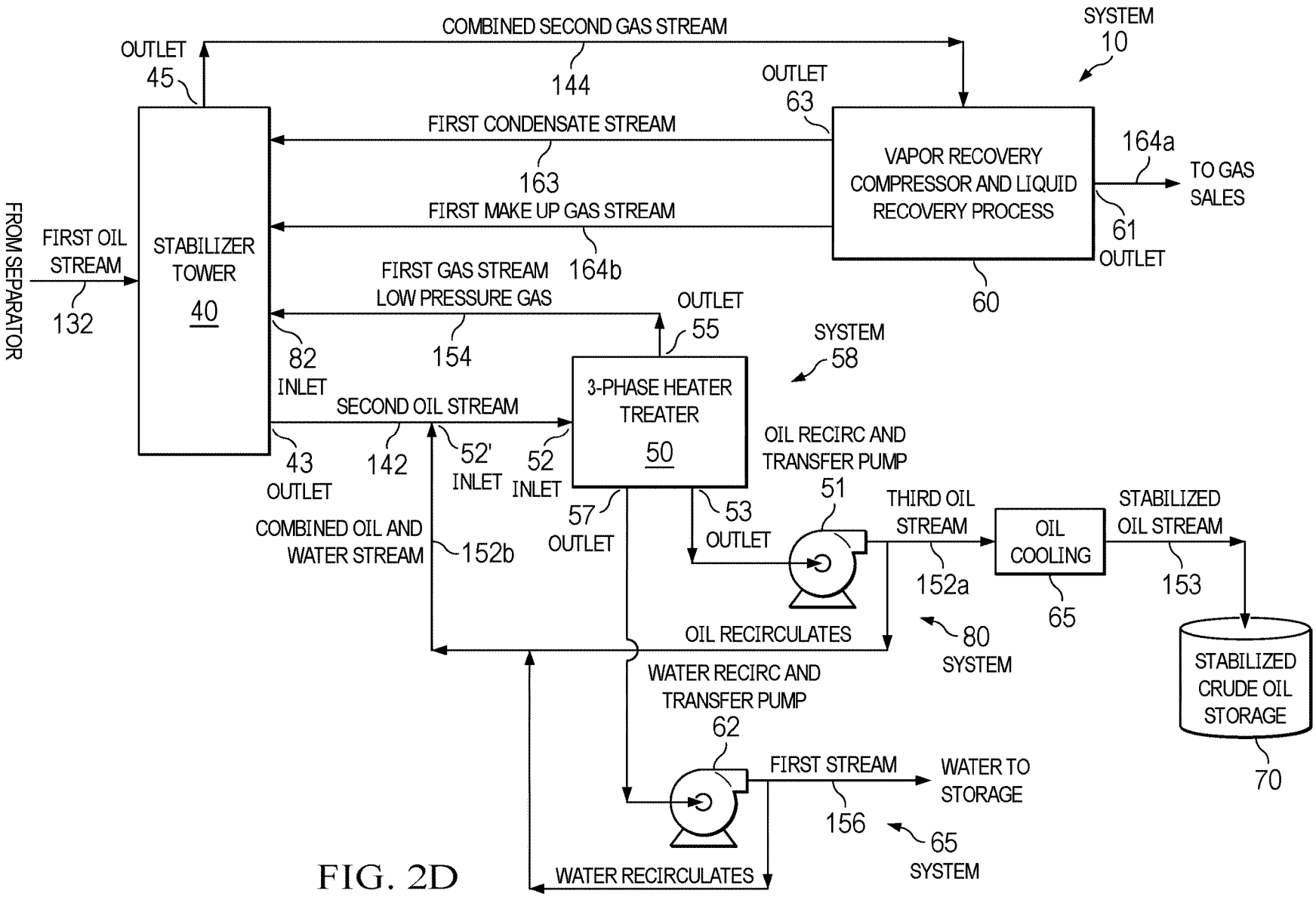

FIG. 2D shows a basic flow diagram of the zero emissions system of the present disclosure, which includes a stabilizer tower upstream of a heater treater. Oil and water pumps recirculate fluids in the heater treater and transfer oil to oil cooling and oil storage, and water to water storage. A first make up gas stream 164*b* is used to balance the stabilizer tower and add gas to the tower and keep a desired oil to gas ratio inside the tower. This keeps an efficient amount of gas inside the tower to contact the oil stream when oil inlet volumes decrease. Oil stream 153 is a stabilized oil stream from oil cooling to oil storage. Water pump 62 transfers water from heater treater to either water storage or will recirculate water to the inlet of the heater treater.

Figure 2E:
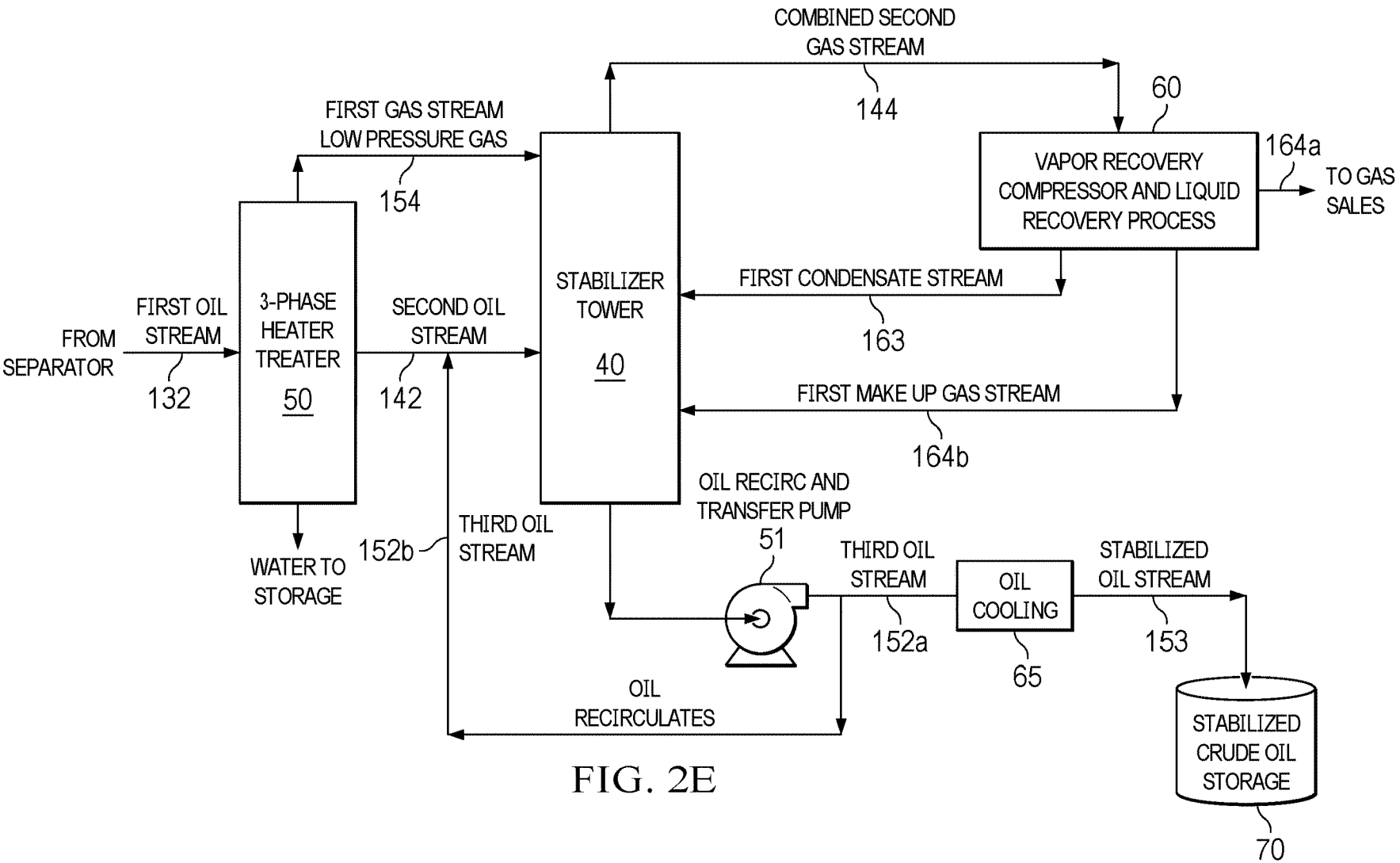

FIG. 2E shows a basic flow diagram of the zero emissions system of the present disclosure and is similar to FIG. 1D. Heater treater upstream of the oil stabilizer tower. The heater treater internal pressure will send gas and oil to the stabilizer tower. Oil pumps recirculate fluids in the tower and transfer oil to oil cooling and oil storage. The oil stabilizer is the only vessel operating at low pressure.

Figure 3A:
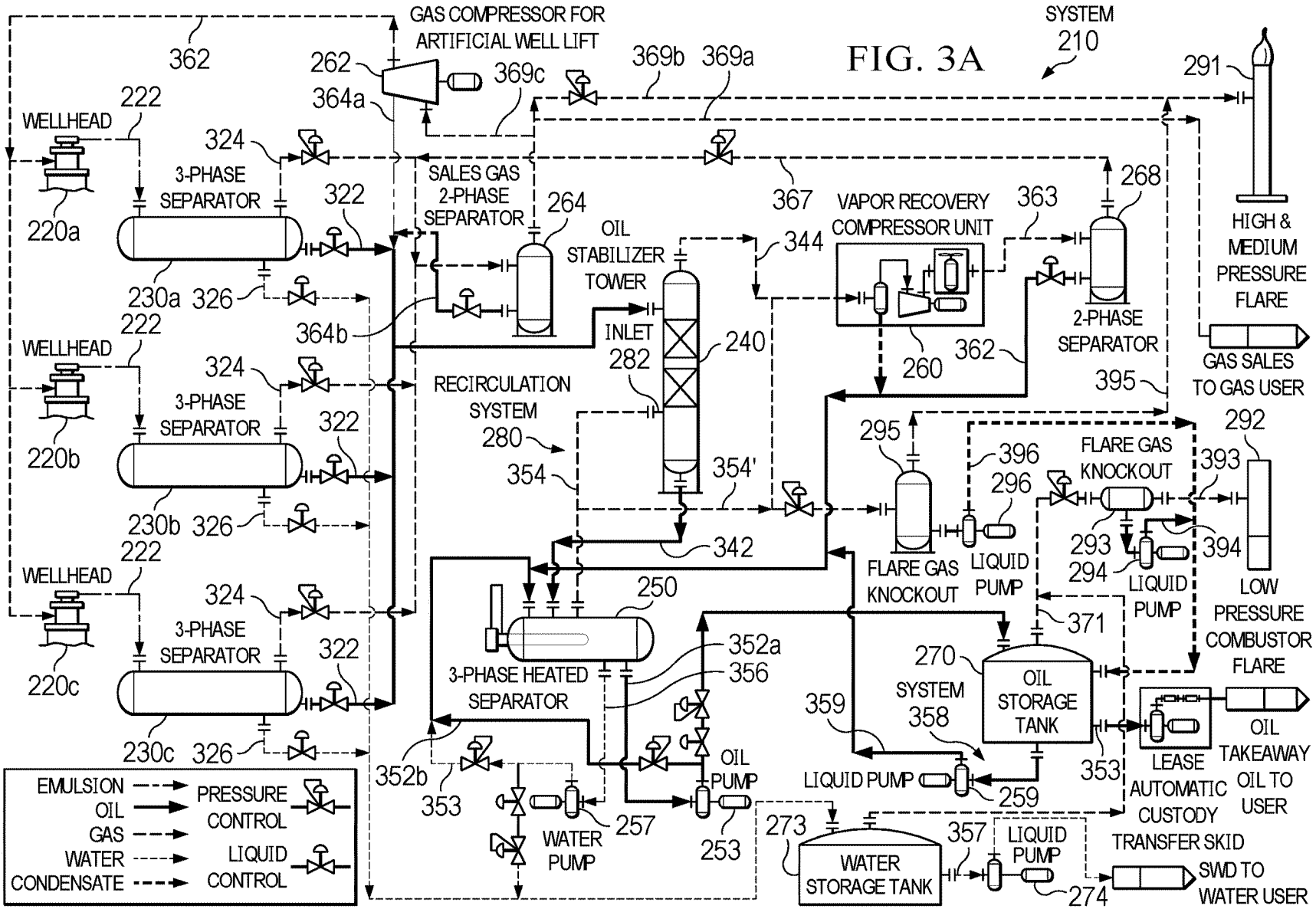

FIG. 3A is a flow process diagram of a second example of a live crude conditioning process.

Figure 3B:
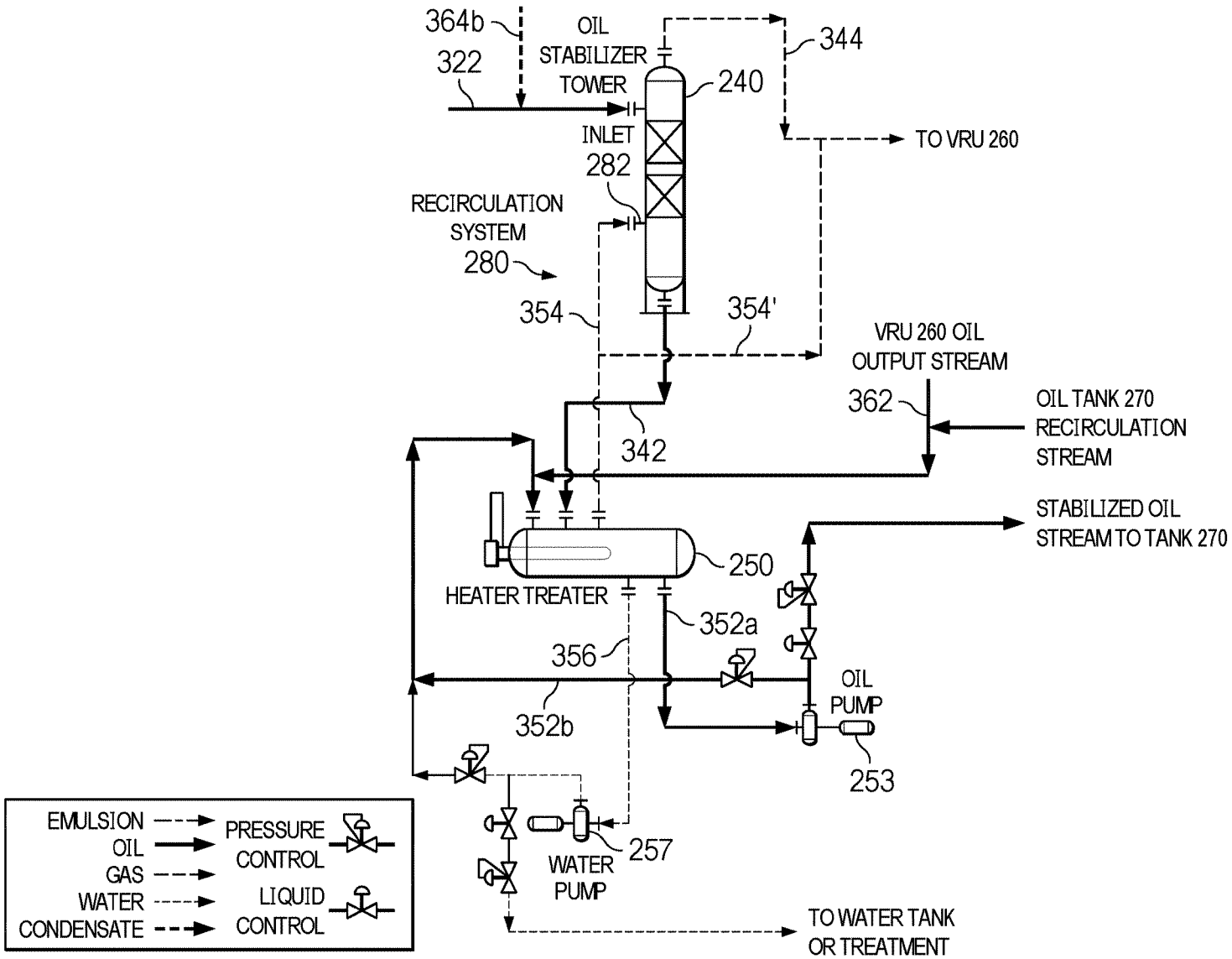

FIG. 3B is an enlarged portion of the flow process diagram of FIG. 3A.

Figure 3C:
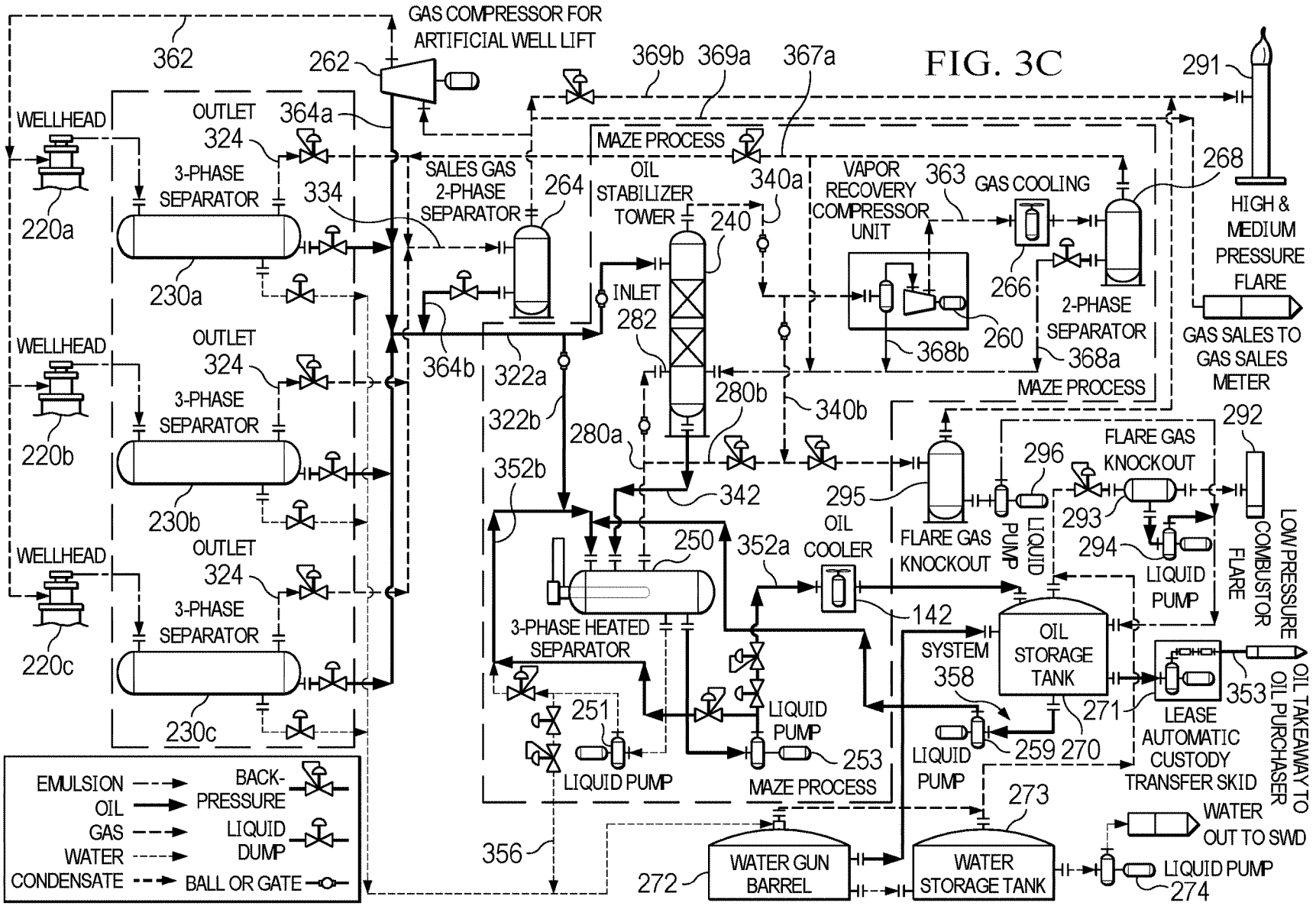

FIG. 3C shows a typical production facility process flow diagram with an oil stabilization tower process to reach zero tank emissions. Oil stream 322*b* bypasses stabilizer tower to send oil to heater treater inlet. Water pump 251 transfers water to water storage or recirculates water to heater treater inlet. Oil pump 253 transfers oil to oil storage or recirculates oil to heater treater inlet. Gas stream 362 from a compressor unit that injects high pressure gas down the tubing of a well head for artificial wellhead lift in attempt to add pressure in a well to get fluids to rise up casing of well head and transfer the emulsion produced from a wellhead to the separator. Gas stream 363 sent to a gas cooling process from the vapor recovery unit 260 to extract liquids out of the gas stream.

Figure 3D:
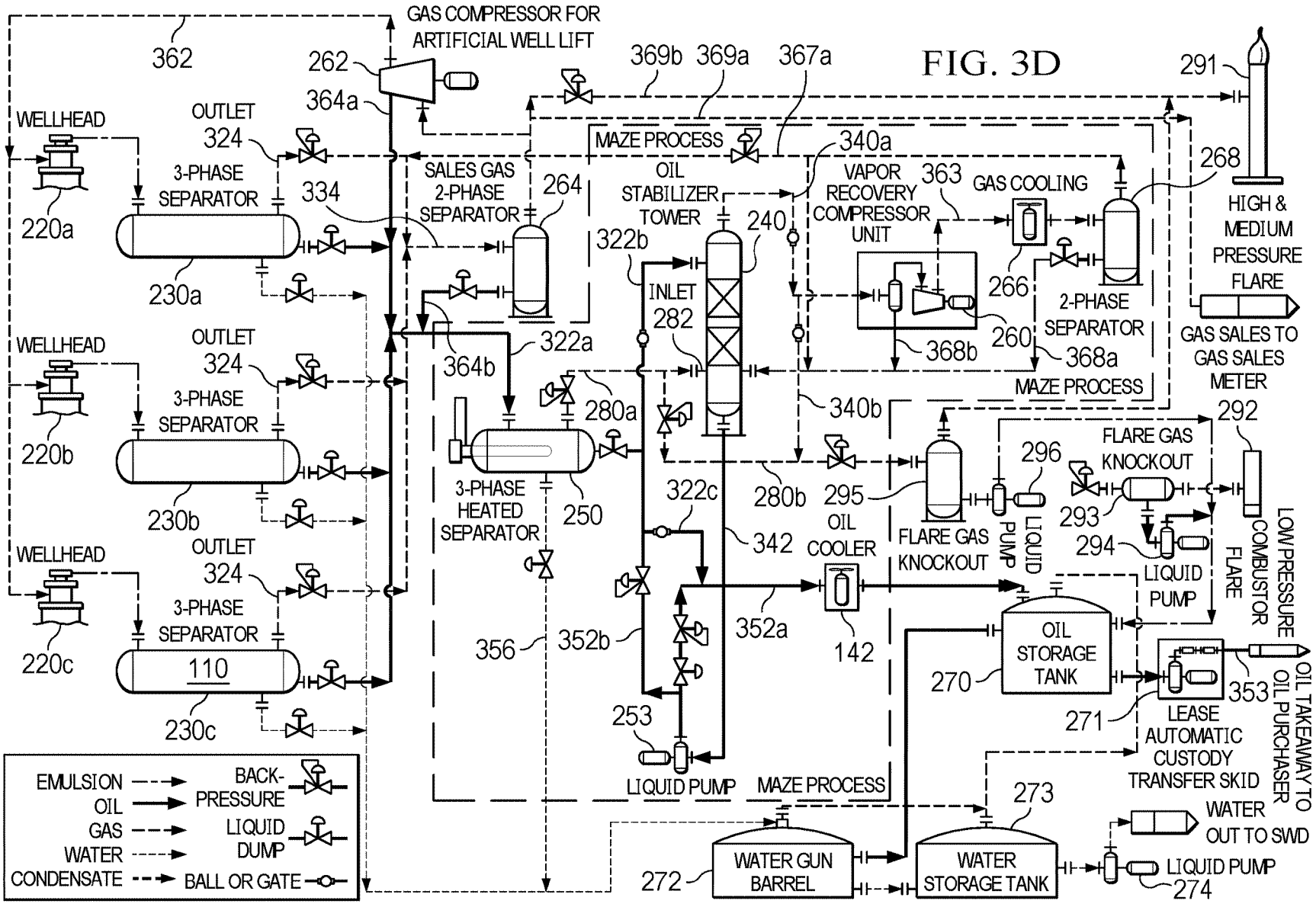

FIG. 3D is similar to the facility process described in FIG. 3C except using the process described in FIG. 1D and FIG. 2E.

Figure 3E:
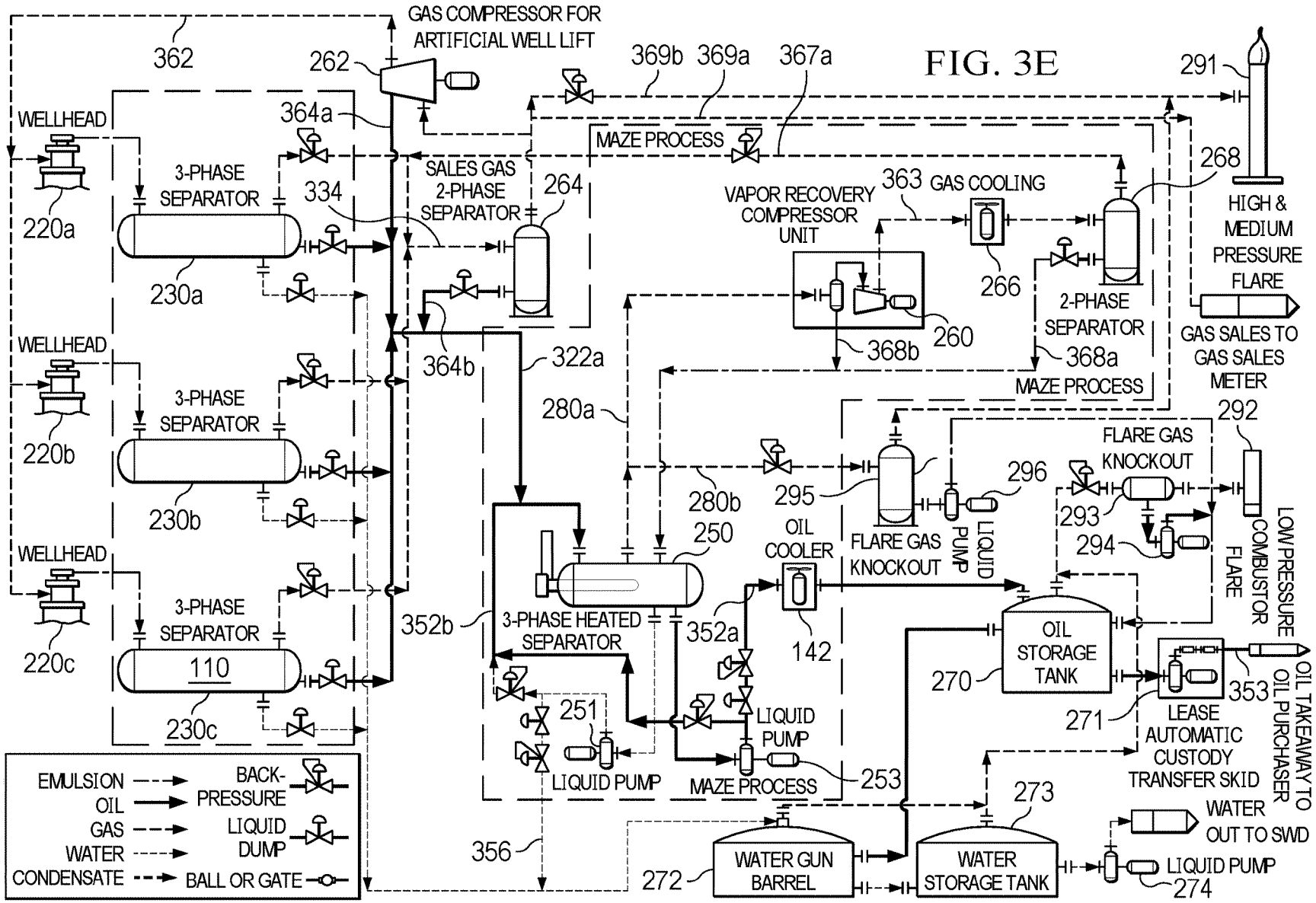

FIG. 3E is similar to the facility process described in FIG. 3C except using the process described in FIG. 1E.

Figure 3F:
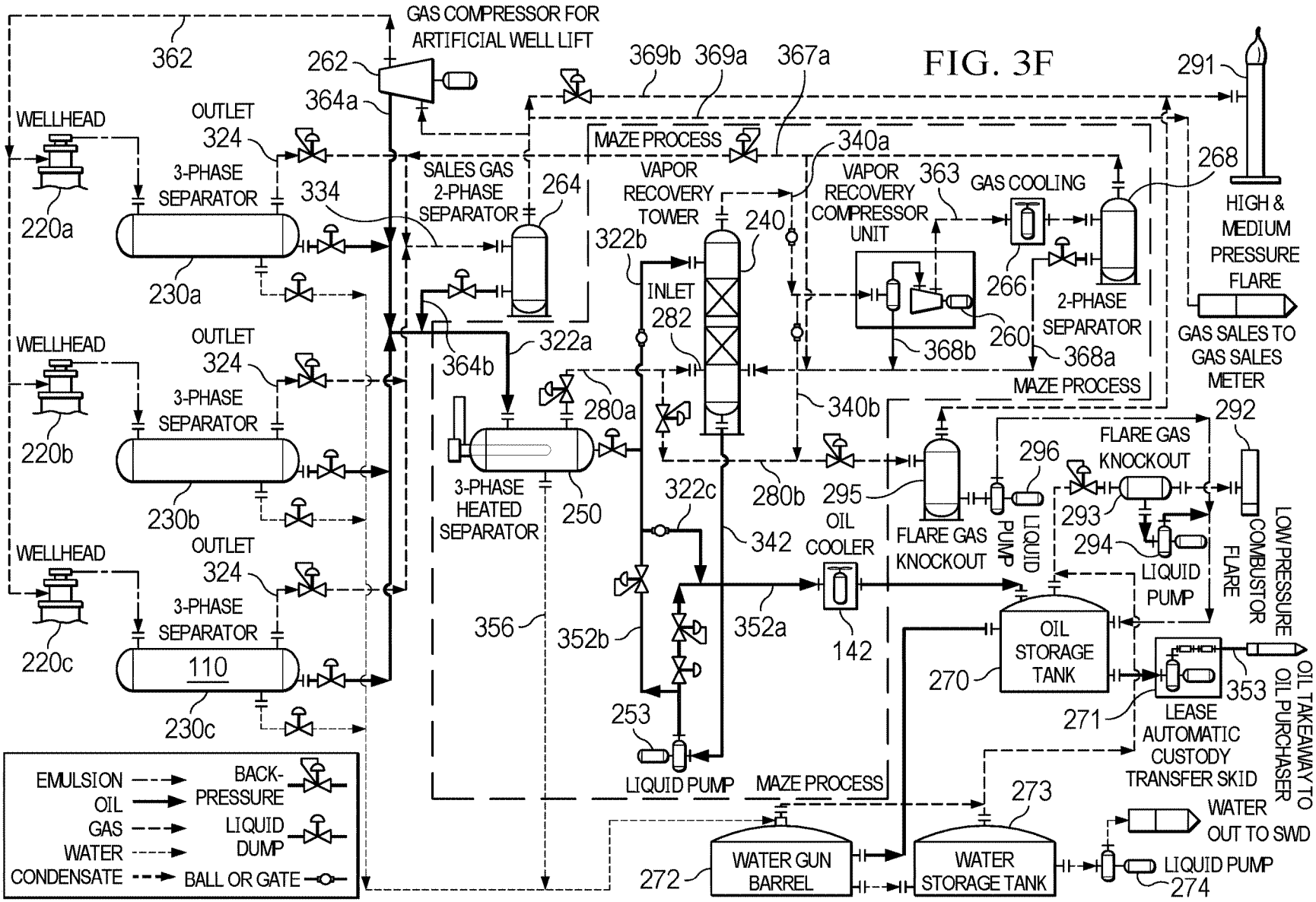

FIG. 3F is similar to the facility process described in FIG. 3C except using the process described in FIG. 1F.

Figure 4A:
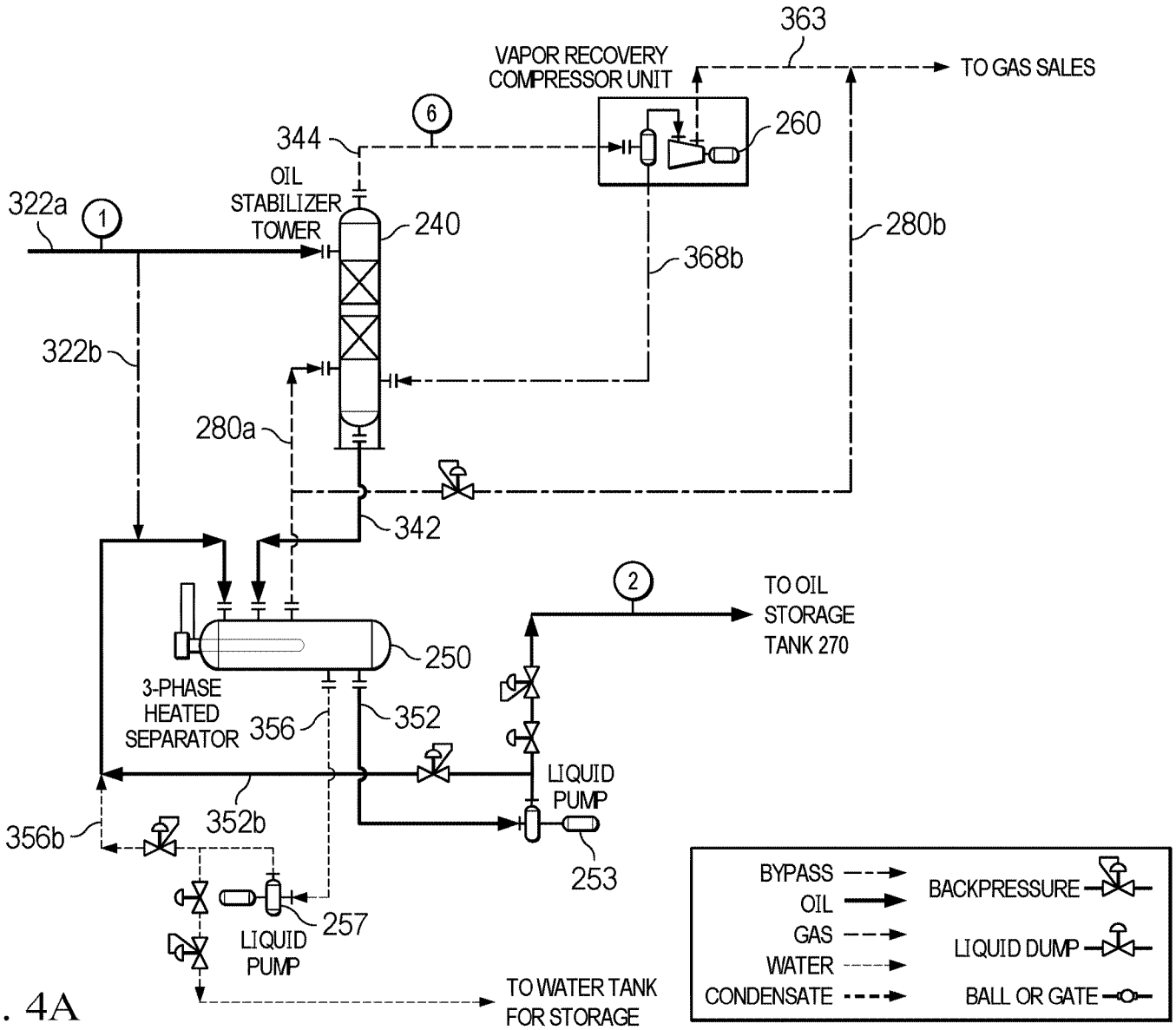

FIG. 4A shows a process for reducing emissions. This process produces reduced emissions and minimizes swell. Since swell is not generated from the compression and cooling process off the vapor recovery compressor, oil cooling is not needed to reduce emissions. Oil outlet stream 352 sends oil to oil storage from heater treater. Recirculating water stream 356*b* from water pump on heater treater.

Figure 4B:
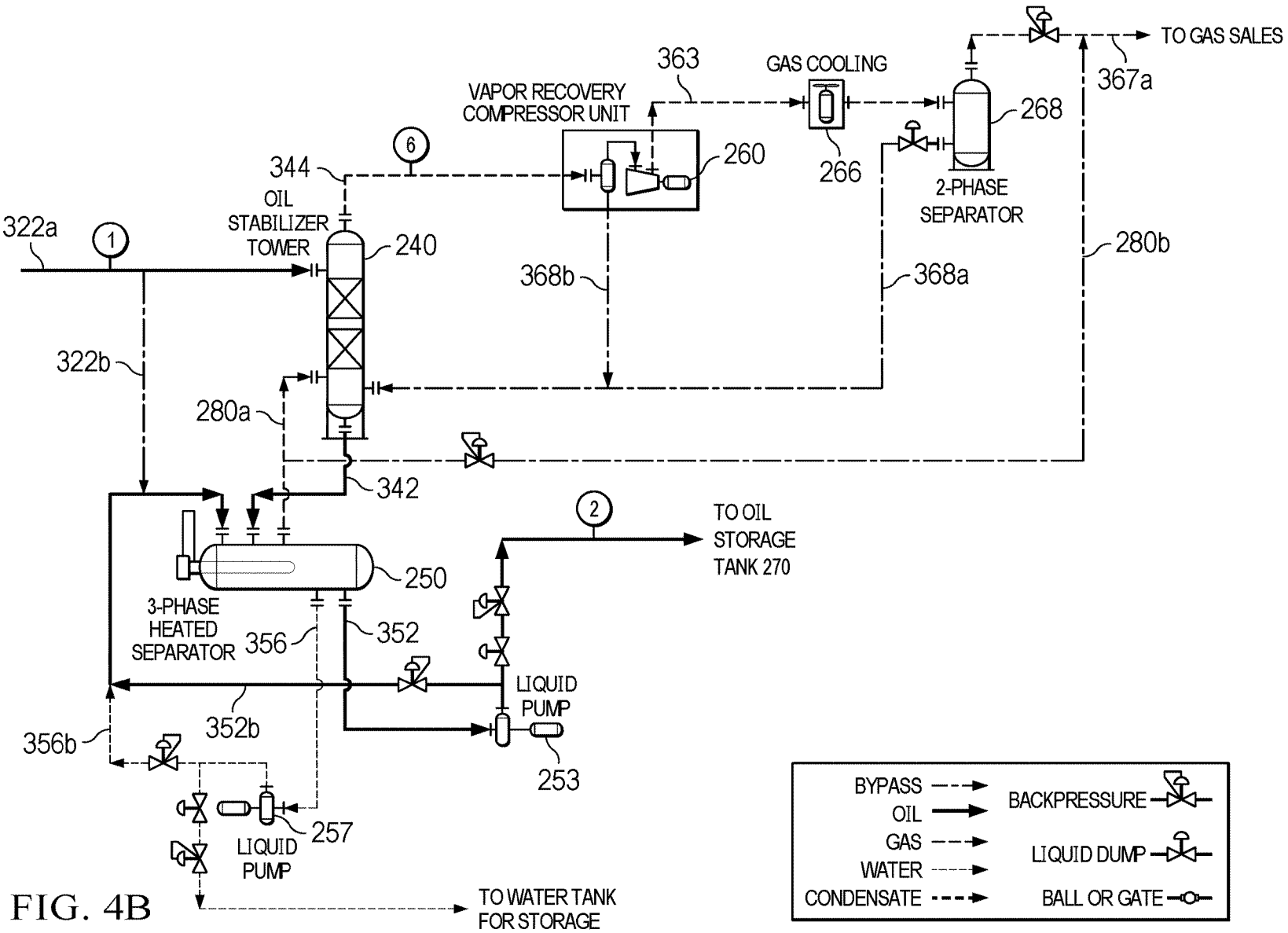

FIG. 4B shows a process for reducing emissions. Oil cooling is not always needed as the heater treater 250 temperature can be increased to make more gas escape from the oil phase in the process and reach near to at zero emissions.

Figure 4C:
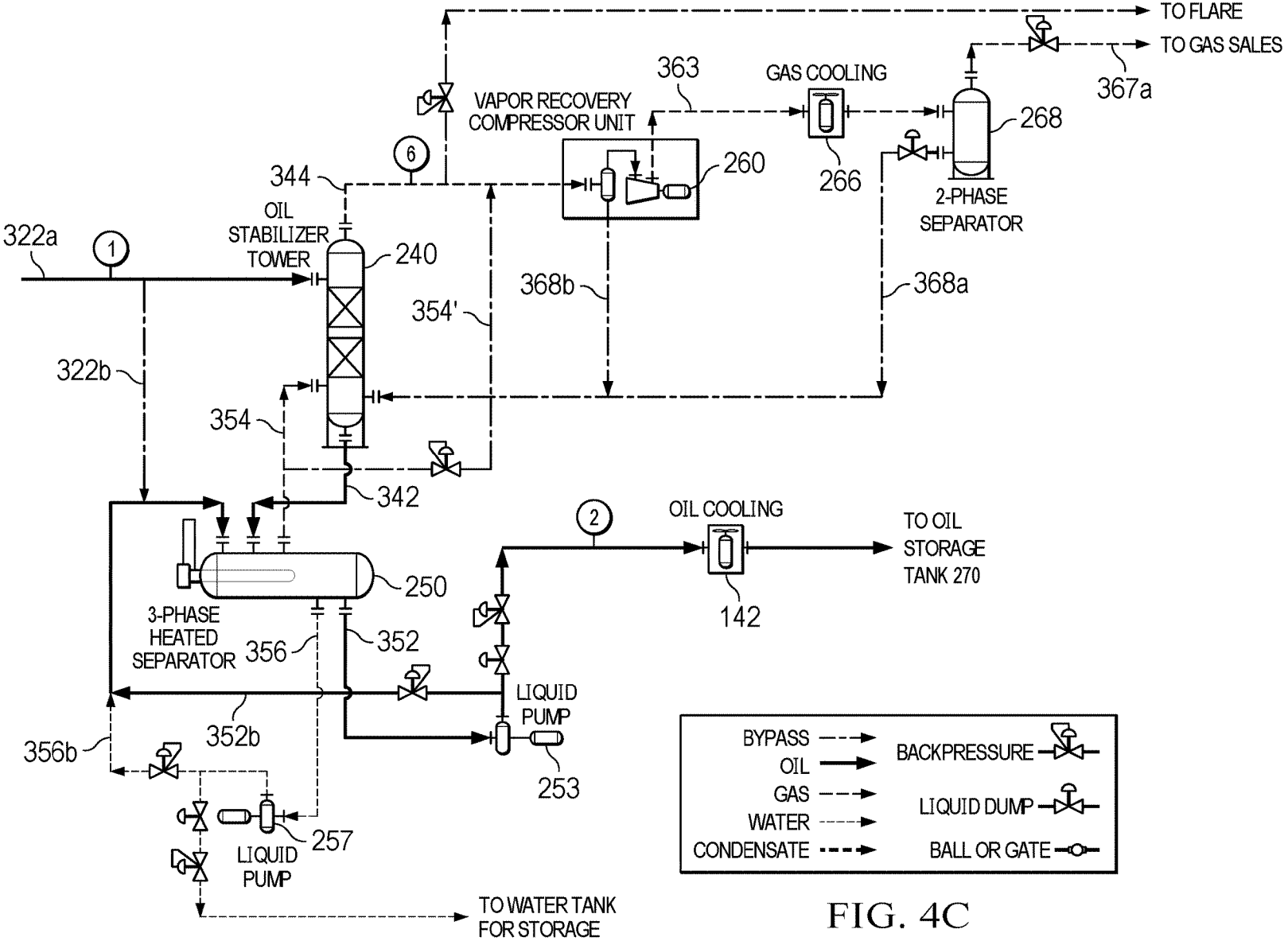

FIG. 4C shows a process for reducing emissions. This process is used and described in FIG. 1C, FIG. 2D, FIG. 3C.

Figure 4D:
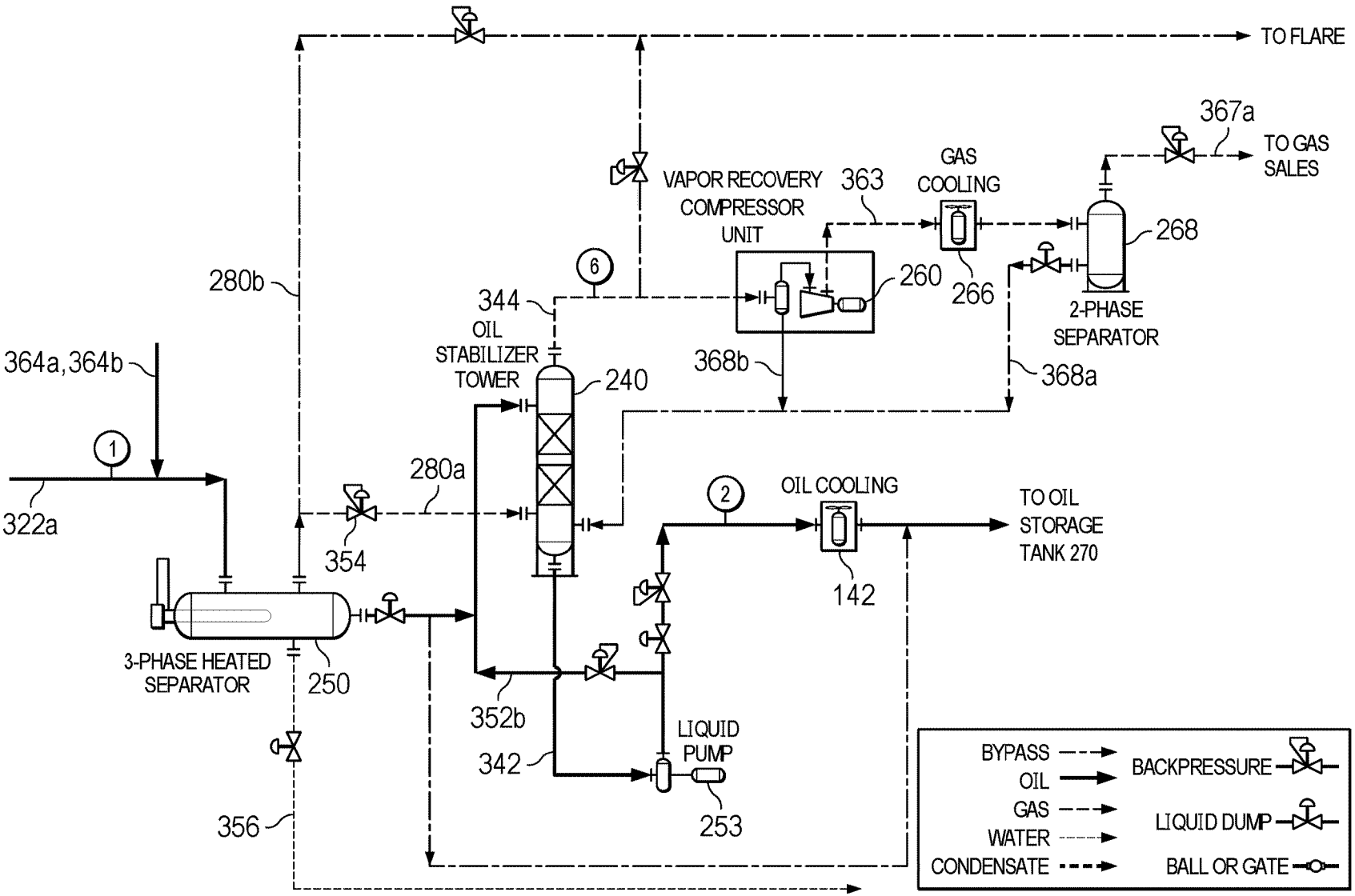

FIG. 4D shows a process for reducing emissions. This process is used and described in FIG. 1D, FIG. 2E, FIG. 3D.

Figure 4E:
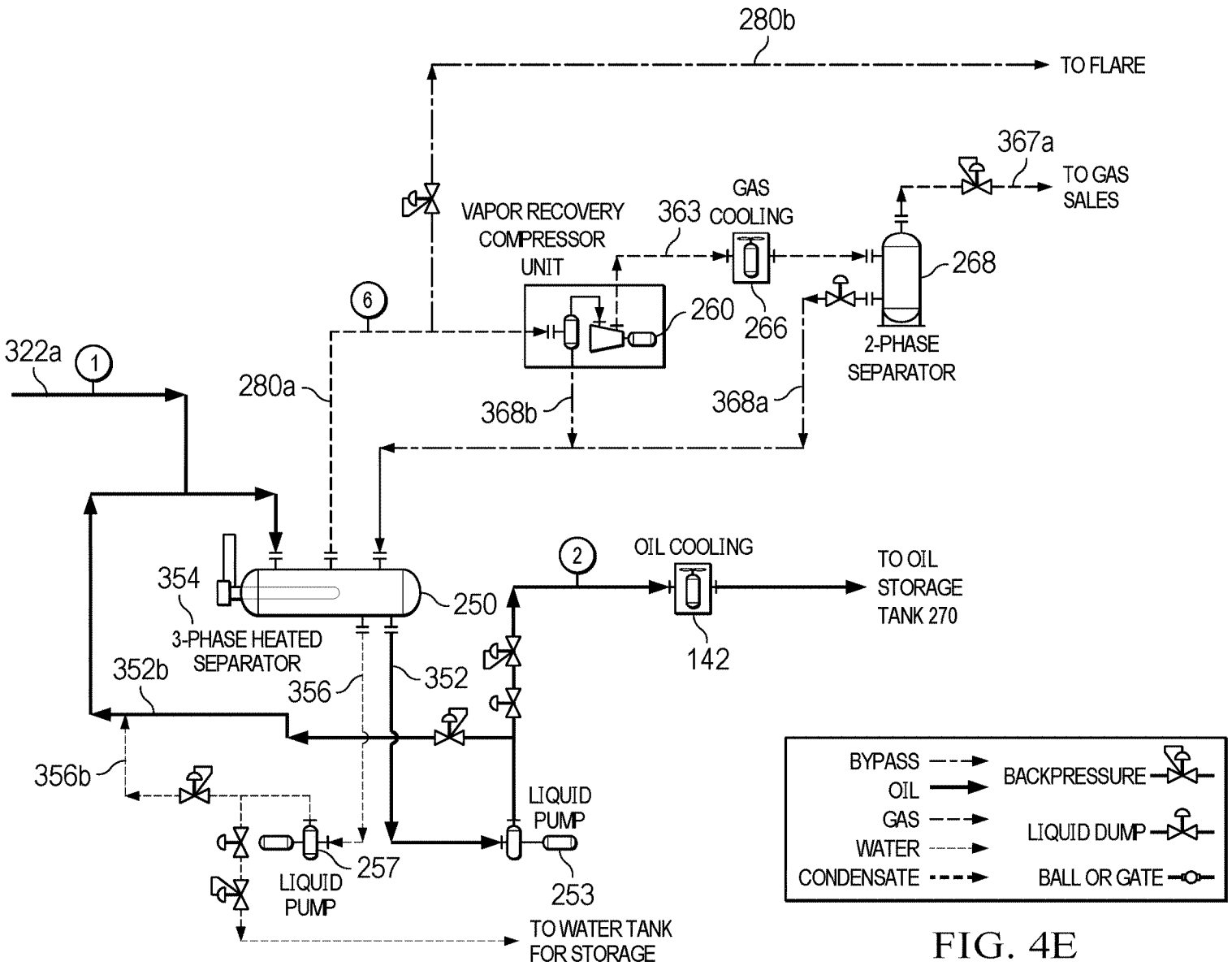

FIG. 4E shows a process for reducing emissions. This process is used and described in FIG. 1E and FIG. 3E.

Figure 4F:
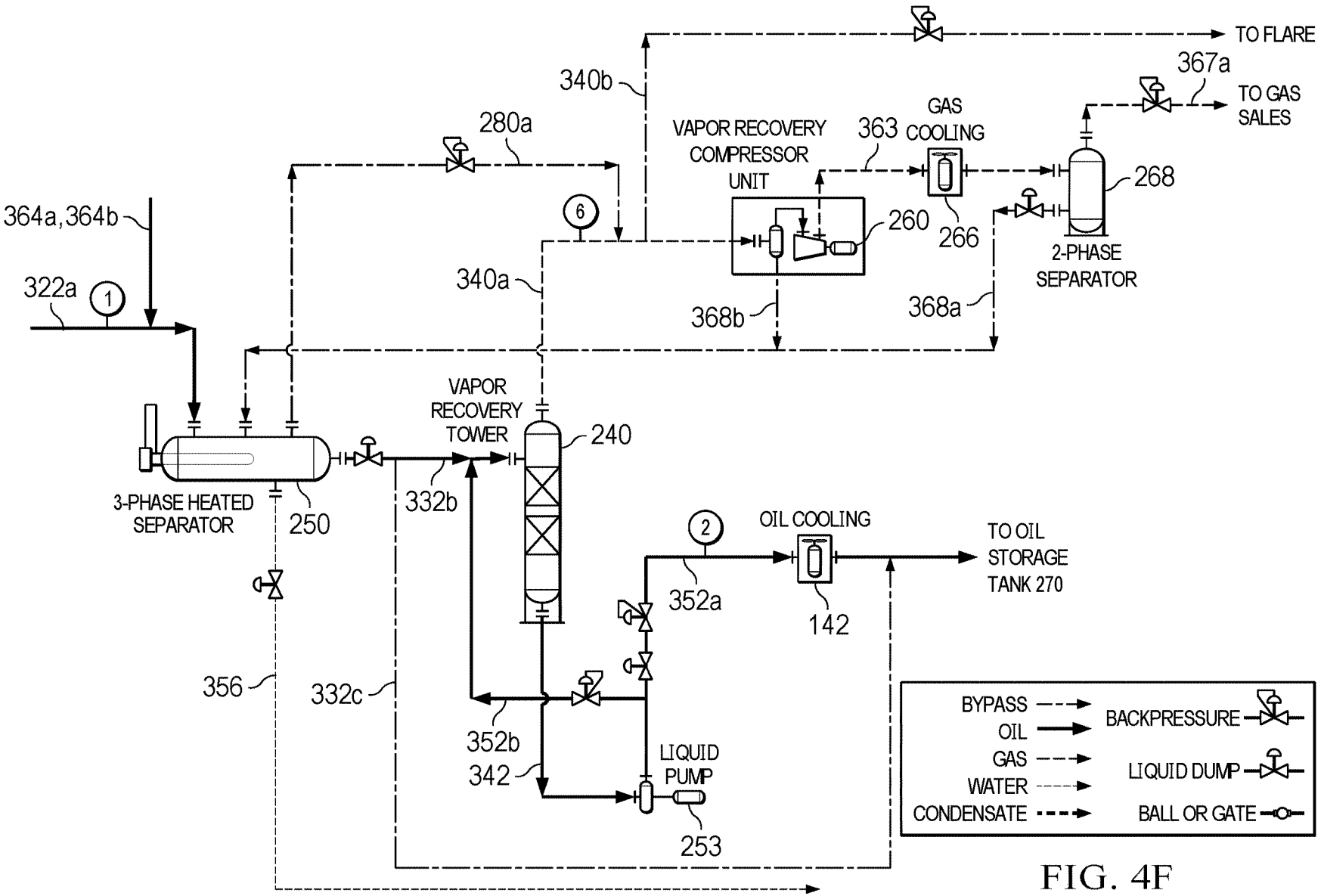

FIG. 4F shows a process for reducing emissions. This process is used and described in FIG. 1F and FIG. 3F.

Figure 5A:
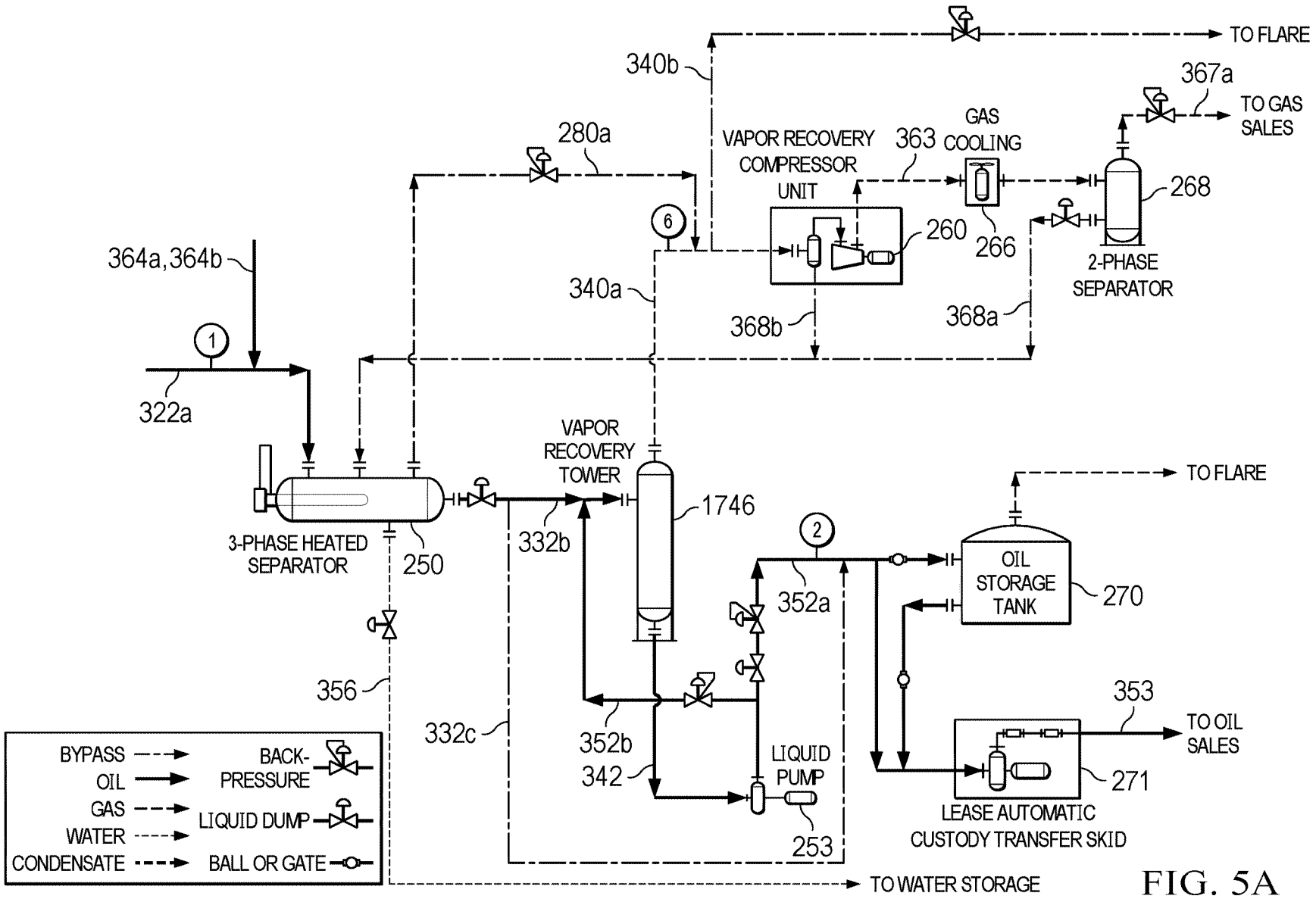

FIG. 5A shows a process for reducing emissions. This process includes using existing equipment, such as a vapor recovery tower 1746. In this process, the vapor recovery tower oil outlet stream 342 may be routed directly to oil sales 353 using a LACT unit 271. This process allows the vapor recovery oil outlet stream 342 to bypass the oil storage tank 270, thereby eliminating the chance of fugitive emissions that are typically produced in oil storage tanks. In some implementations, operating the vapor recovery tower 240 at low pressure and bypassing the oil storage tank 270 can decrease emissions. In some implementations, oil produced by the VRU and gas cooling process may be sent to the heater treater inlet. In more detail, gas stream 363 flows through gas cooler 266 and separator 268. The liquid that is collected by separator 268 then flows to heater treater 250.

Figure 5B:
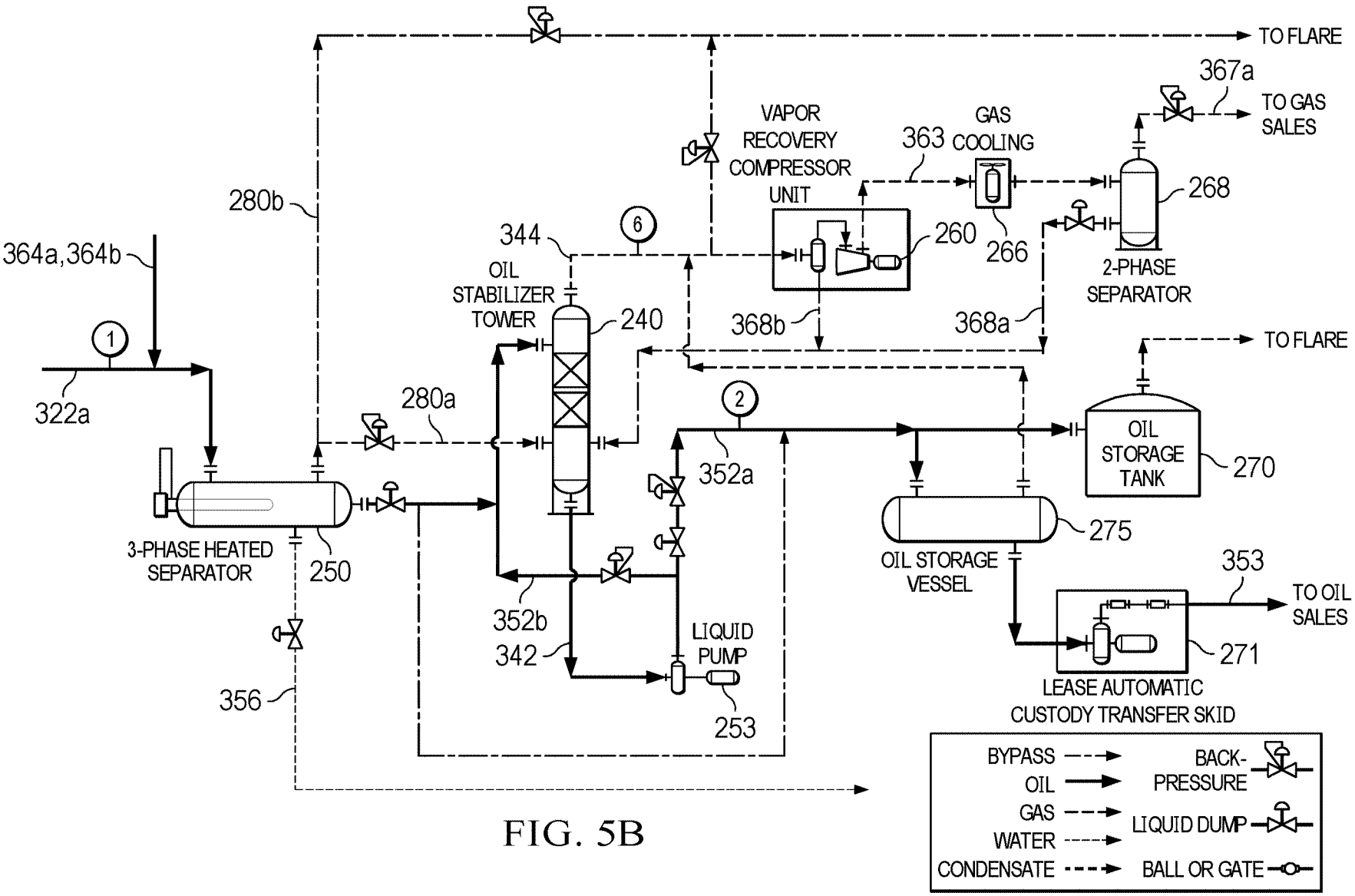

FIG. 5B shows a process for reducing emissions. This process is similar to the process shown in FIG. 5A, except it uses an oil stabilizer tower 240 instead of a vapor recovery tower 1746 and further includes a two-phase oil storage vessel 275 through which the oil stabilizer tower oil outlet stream 342 is routed. The LACT unit 271 receives the oil outlet stream from the oil storage vessel 275 and sends it directly to oil sales 353. Like the process shown in FIG. 5A, the oil storage tank 270 is bypassed to eliminate fugitive emissions that are typically produced in oil storage tanks.

Figure 6:
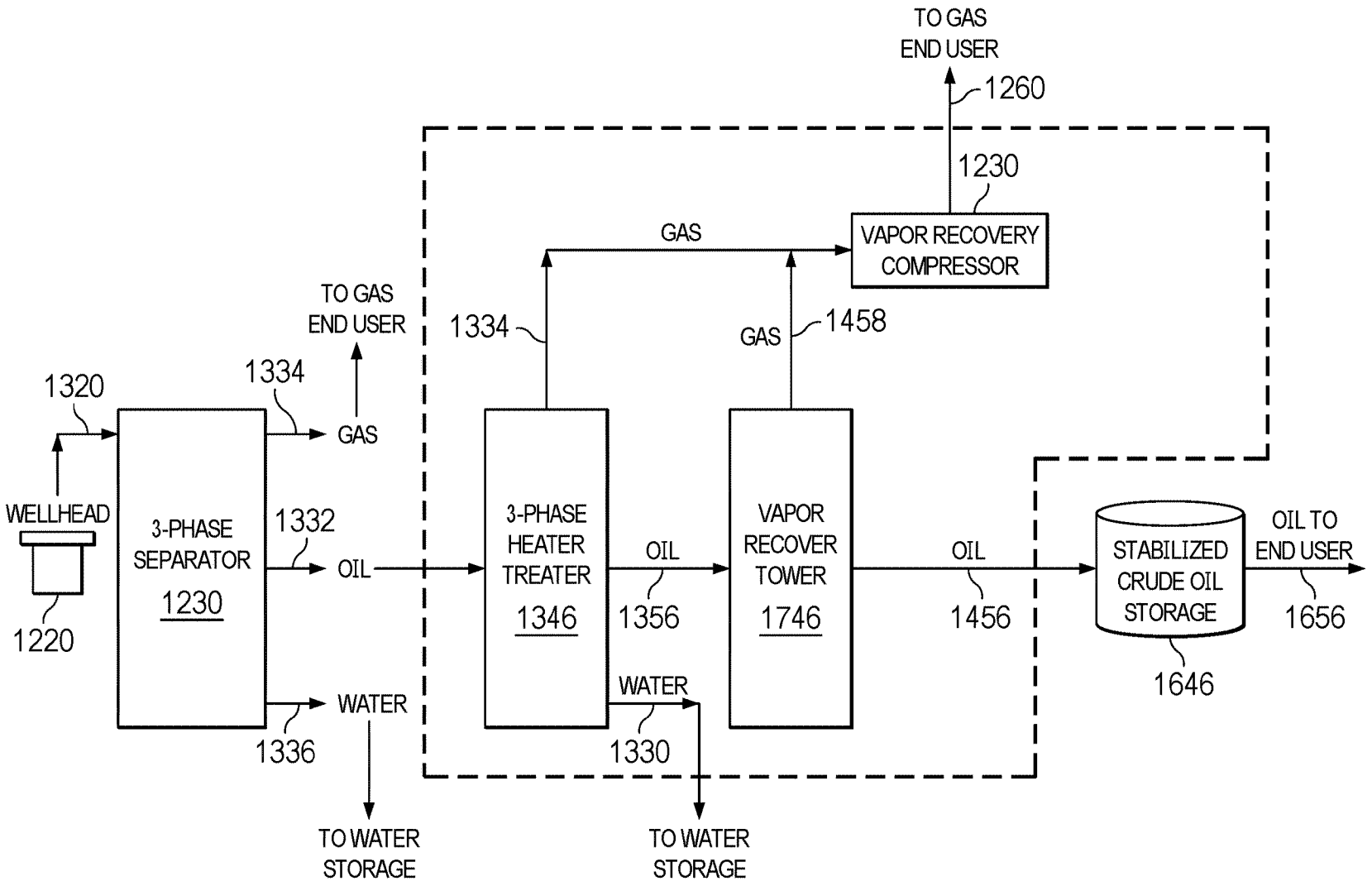
FIG. 6 (PRIOR ART)

FIG. 6 (Prior Art) shows a simple diagram of a production facility. This figure is similar to FIG. 1B except it shows a stream of oil 1656 can be drawn from the stabilized crude oil storage tank 1646 and sent to an end user.

Figure 6A:
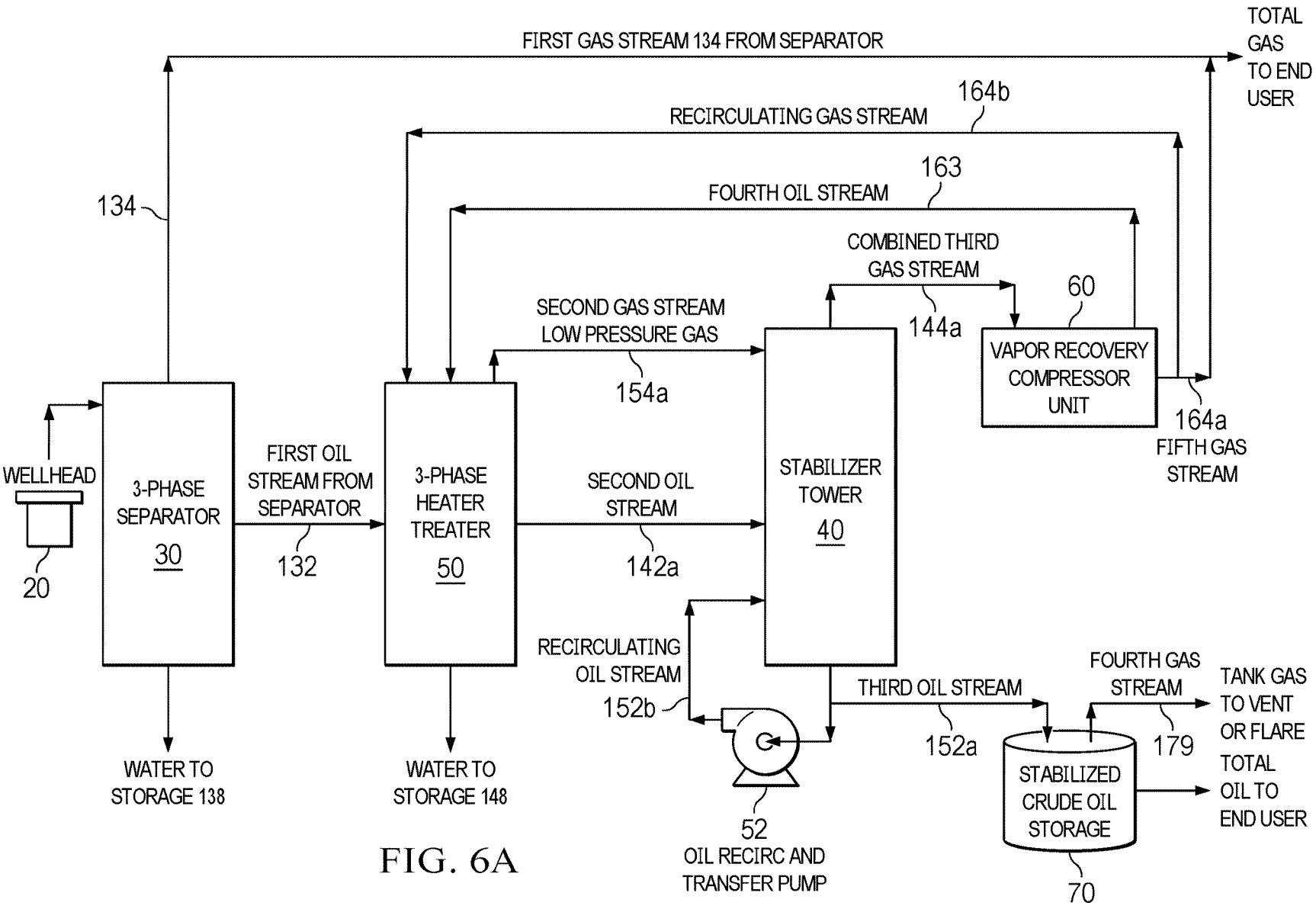

FIG. 6A shows a process for reducing emissions. This figure is similar to FIG. 1D, FIG. 2D, FIG. 3B and FIG. 4D except the system may rely on gravity to flow third oil stream 152*a* to the inlet of the stabilized crude oil storage tank 70. In addition, oil cooling is removed from this process. A fourth oil stream 163 may transferred with the use of pressure from the VRU 60 to the heater treater 50. Oil recirculating and transfer pump 52 may optionally be included to transfer recirculating oil stream 152*b* to the inlet of stabilizer tower 40 and/or to transfer third oil stream 152*a* to storage tank 70.

Figure 6B:
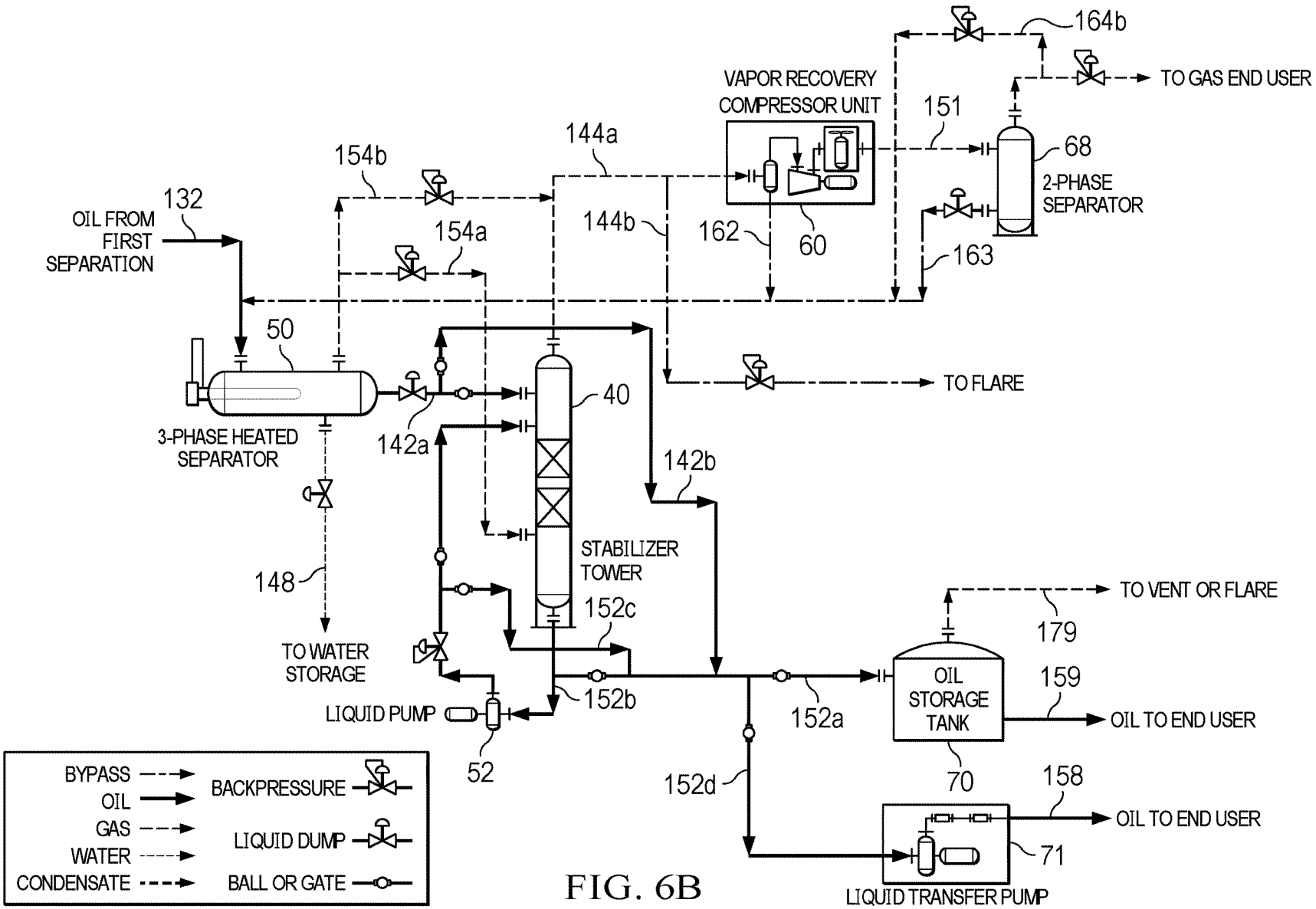

FIG. 6B shows a process for reducing emissions. This figure is similar to FIG. 6A but shows how the system would operate using control valves and with different operating pressures and temperatures throughout the process.

Figure 6C:
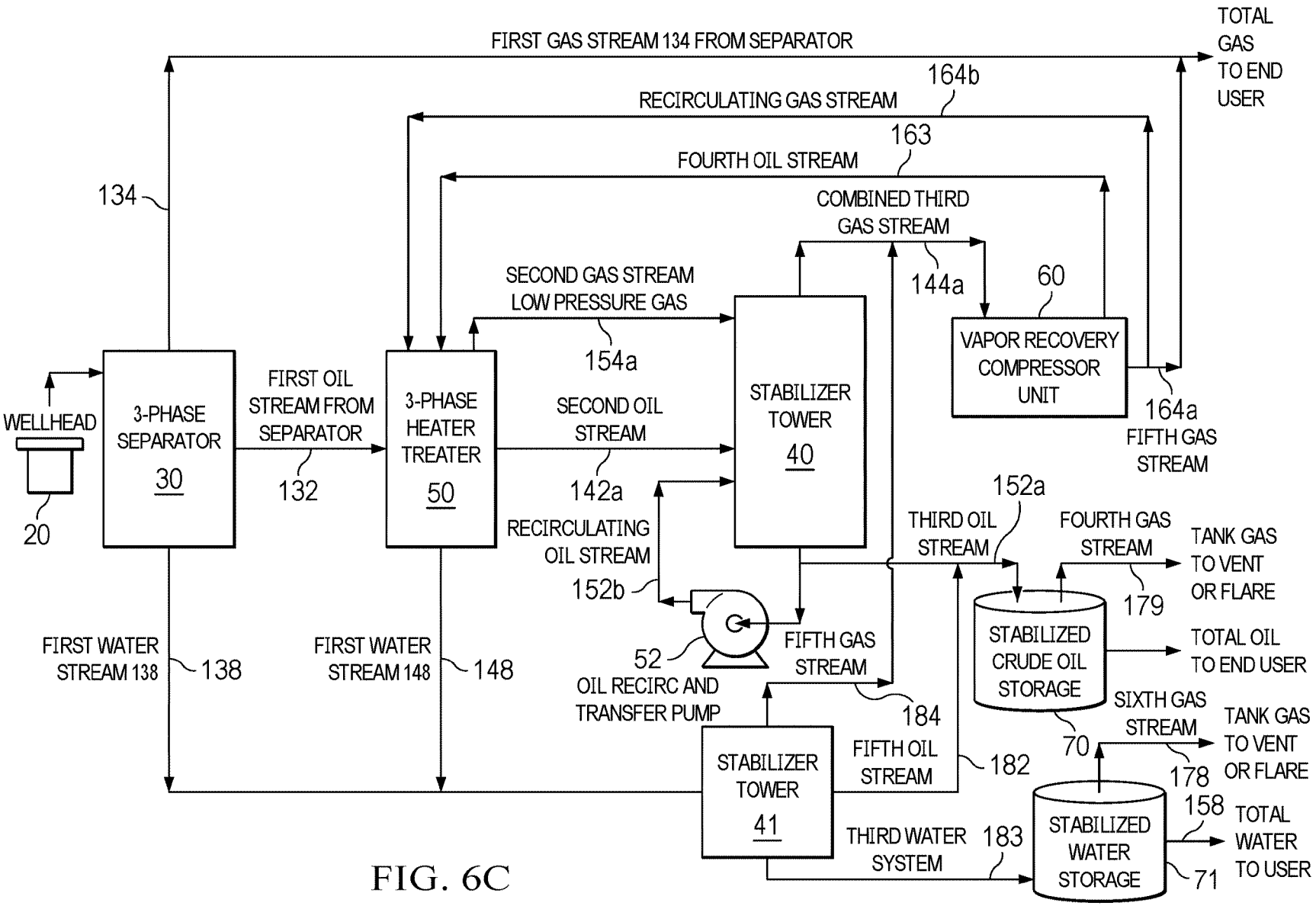

FIG. 6C shows a process for reducing emissions. This figure is similar to FIG. 6A but includes a second stabilizer tower 41 that may receive first water stream 138 from the separator 30 and/or second water stream 148 from the heater 50 to produce fifth gas stream 184 that routes to the VRU 60, fifth oil stream 182 that gravity flows to the stabilized crude oil storage tank 70, and third water stream 183 that gravity flows to a stabilized water storage tank 71.

Figure 6D:
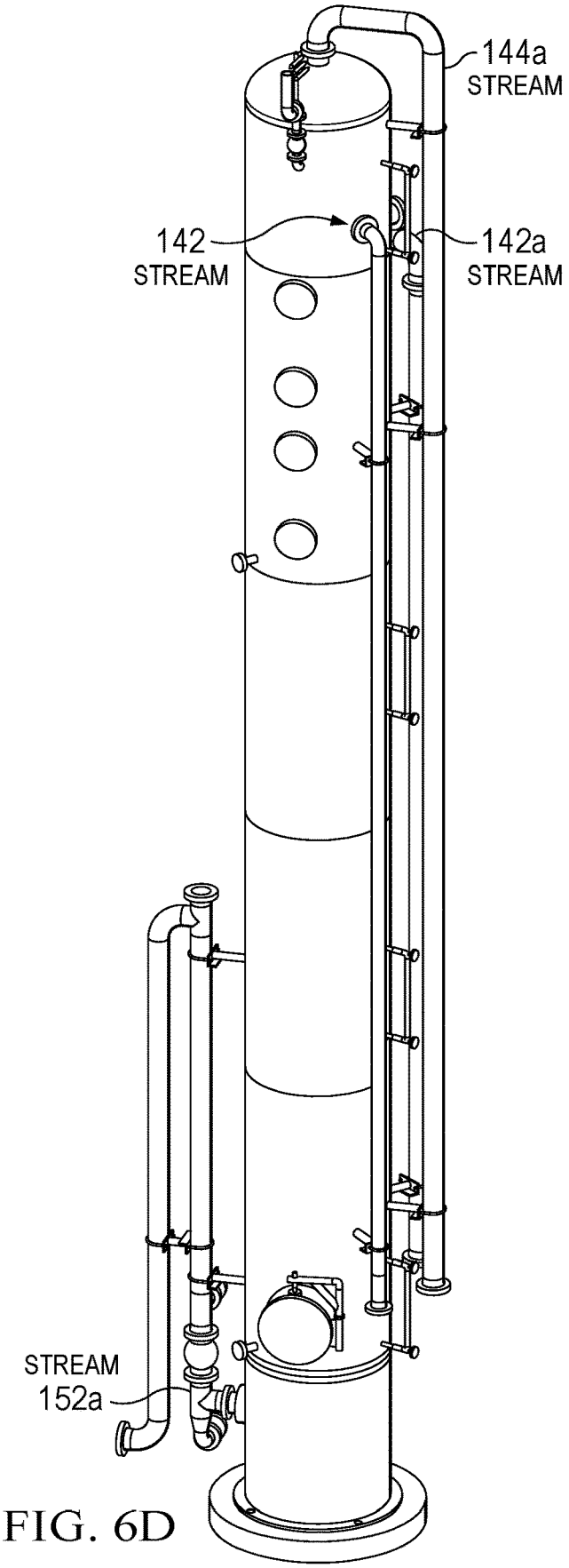

FIG. 6D shows an isometric view of a stabilizer tower 40, 41 of the present disclosure, which may also be referred to herein as a vapor and liquid recovery tower or VLRT, as well as inlet lines for streams flowing into the VLRT and outlet lines for streams flowing out of the VLRT. The VLRT of the present disclosure may be used as the stabilizer towers 40, 41 in the processes of FIG. 6A through FIG. 6C, for example.

Figure 6E:
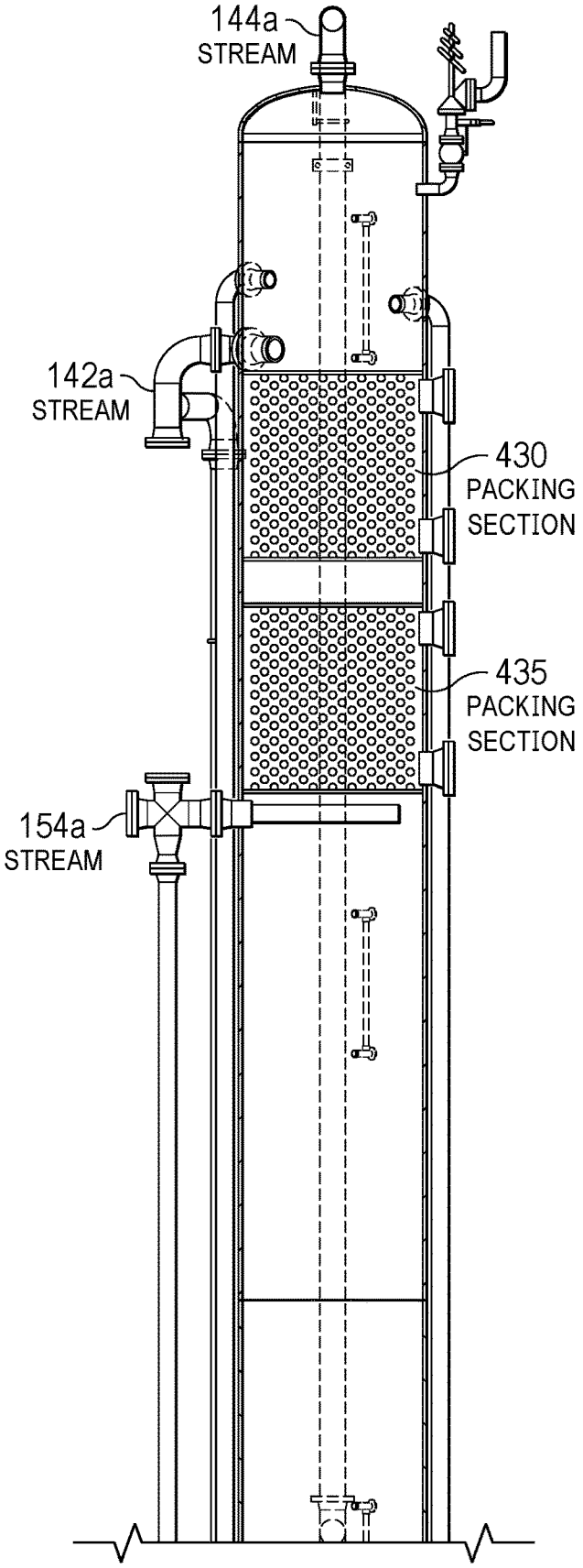

FIG. 6E shows a side cross-sectional view of an upper portion of the VLRT, which includes a top packing section 430 and a bottom packing section 435.

Figure 6F:
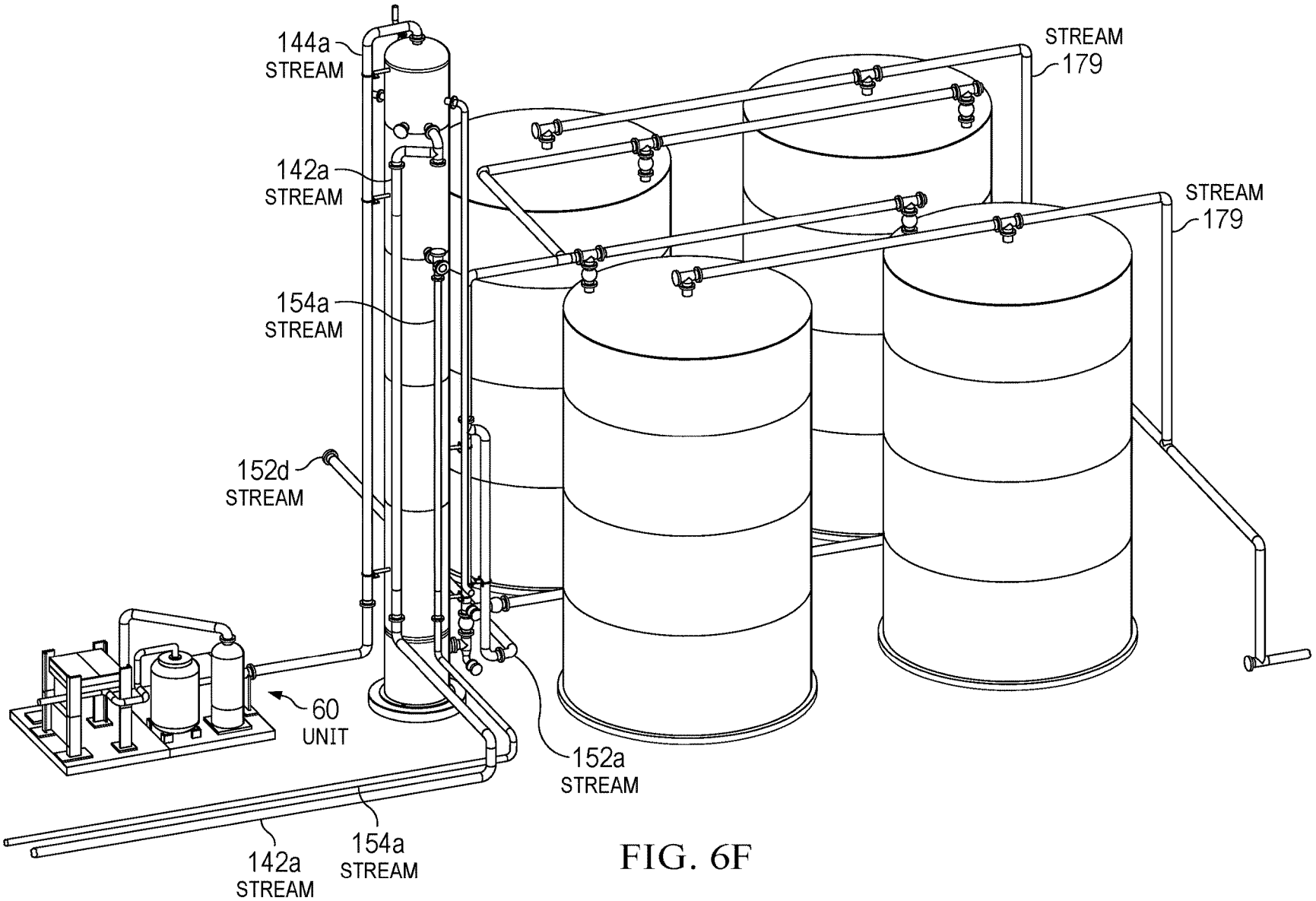

FIG. 6F shows an isometric view of a representative partial system 1000 that includes the VLRT that receives the second oil stream 142*a* from the heater treater 50 and the second gas stream 154*a* from the heater treater 50, and that produces third oil stream 152*a*, which that can be routed directly to one or more oil storage tanks 70, or can be routed to a LACT unit 60.

Figure 6G:
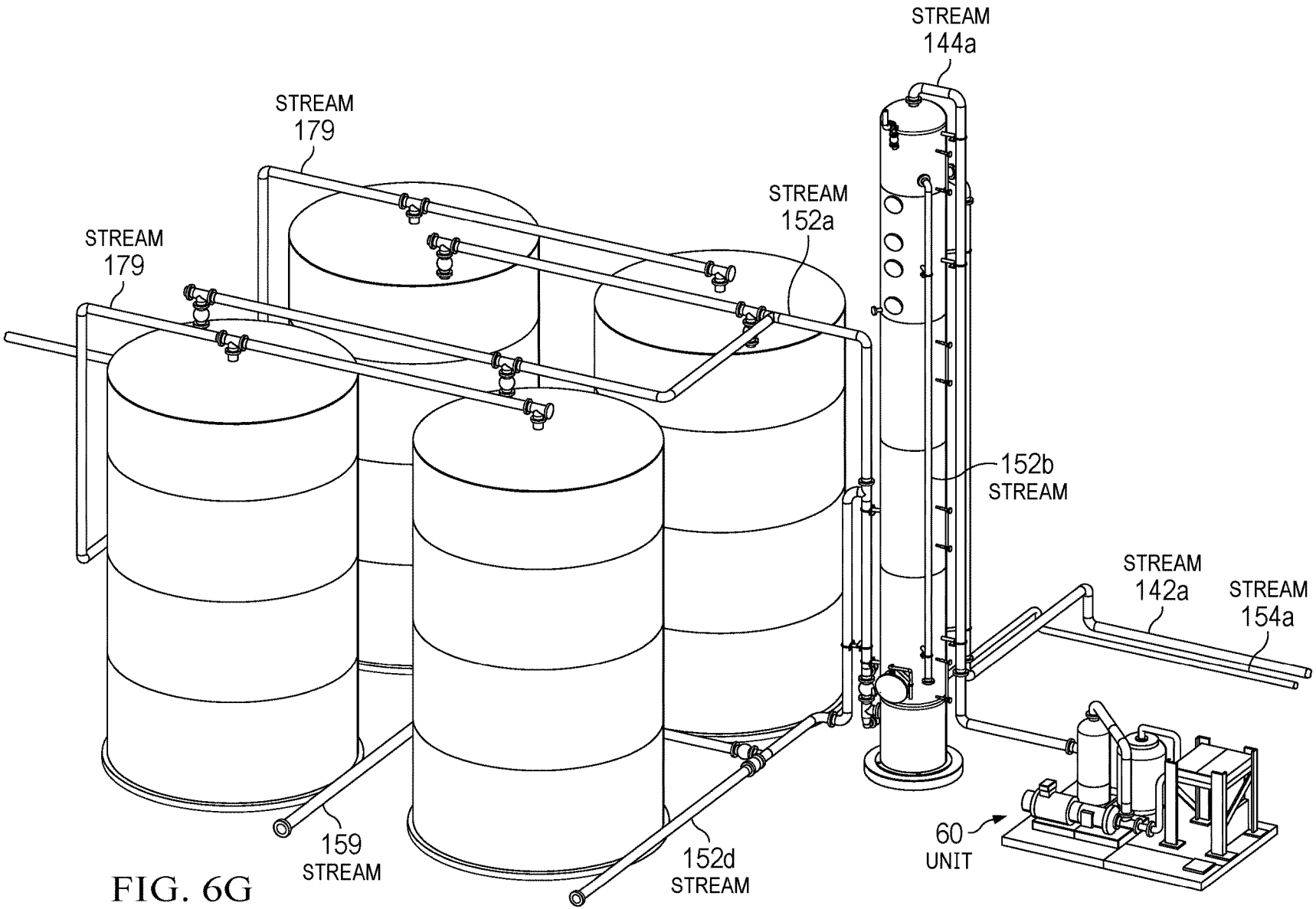

FIG. 6G shows an isometric view of the representative partial system 1000 of FIG. 6F from a different vantage point, rotated approximately 180 degrees from the view of the system 1000 shown in FIG. 6F.

DETAILED DESCRIPTION

Stabilizer Tower to Heater to Tank System

To illustrate a first example of a system for stabilizing crude oil, a system 10 for stabilizing live crude oil includes a separator 30, a stabilizer such as a stabilizer tower 40, a heater treater 50, a vapor recovery unit 60, a stabilized oil tank 70, and an oil and gas recirculation system 80.

As illustrated in FIG. 2A, separator 30 receives a first oil stream 122 from a wellhead 20 at inlet 32. First oil stream or live crude feed 122 typically includes an emulsion of oil, gas, and water directly from wellhead 20. The terms "first oil stream" and "live crude oil" encompasses any conventional wellhead pressures and temperatures and composition of hydrocarbons, according to API specifications. In this regard, wellhead pressures range from 2,000 to 150,000 psi (138 to 10,300 bars). Further the terms "first oil stream" and "live crude oil" encompass any conventional oil and gas stream from a wellhead, including but not limited to emulsions, such as with water or other liquid. It is understood that several wellheads 20 can feed a single separator 30, and the symbol in FIG. 2A for separator 30 can represent several separators in parallel.

Separator 30 is illustrated in FIG. 2A as a vertical separator, including a stream carrying live crude 122 to the top half of the separator 30. The separator 30 produces a separator oil outlet stream 132 (also referred to herein as a first oil stream) at an oil stream outlet 33, a separator gas outlet stream 134 (also referred to herein as a first gas stream) at a gas stream outlet 35, and optionally a separator water outlet stream 136 (also referred to herein as a first water stream) at a water outlet 37. The separator water outlet stream is optional, as system 10 encompasses two phase and three phase separators.

Separator 30 may, in some vertical, three-phase configurations, include an inlet diverter and a mist eliminator, an oil level controller and oil dump valve, and a water dump valve. Separator 30 may also (or alternatively) include a downcomer and spreader, an interface controller and water dump valve, and oil weir level controller and oil dump valve. Other configurations of separator 30 and/or multiple stages may be employed. Separator 30 is not limited to vertical separators, as other configurations, such as horizontal separators, may be employed. Separator 30 often is near the one or more wellheads 20, often as close as can be conveniently located. Separator 30 often can be remotely located, such as a mile from the wellhead 20.

Stabilizer tower 40 yields a stabilizer oil output stream 142, also referred to as second oil output stream 142, from an oil outlet 43. Accordingly, stabilizer tower 40 can include a liquid level controller and corresponding valves and instrumentation for operating stabilizer tower 40 as a two-phase process.

The design features of separator 30 may be chosen and designed according to the process conditions, such as pressure, temperature, and live crude feed characteristics, and according to industry standards, as will be understood by persons familiar with oil and gas stabilization. Further, it is understood that separator 30 may include piping, valves, controls, and the like to perform is separation function, such as a gas back pressure valve, flare valve, a gas flow measurement device, and the like in the separator outlet gas stream piping.

Of the separator output streams, gas stream 134 is typically suitable for use and can thus be sold to end users, and water stream 136 typically goes for water treatment, reinjection, or the like. As illustrated in FIG. 2B, oil stream 132 goes to stabilizer tower 40.

Pressure within stabilizer tower 40 typically is controlled by a gas back-pressure valve (or the like) to a pressure that often is no more than approximately 200 psi (14 bar). The liquid within stabilizer tower 40 flows by gravity through a series of trays, packing, and/or other media for stripping of gas from the liquid. In this regard, the internal components of stabilizer tower 40 may be chosen and configured in any way, as will be understood by persons familiar with oil stabilization and stabilizer tower technology.

As described more fully below, stabilizer tower 40 includes an inlet 82 for receiving a heater treater gas output stream 154. Thus, the gas output of stabilizer tower 40 is referred to as a combined gas stream 144, also referred to as a combined second gas stream 144, as a gas outlet 45.

Vapor recovery unit (VRU) 60 includes a compressor, often a screw type, that receives the combined gas stream 144 from stabilizer tower gas outlet 45. VRU 60 can also include a demister, valves and controls, other conventional components. VRU packages are commercially available, as will be understood by persons familiar with oil stabilization technology.

Liquid from the compression is discharged from VRU 60 at an oil outlet 63 to yield a VRU output oil stream 163 (that is, condensate), which can be controlled to be approximately at heater treater pressure. Oil stream 152*b* enters into heater treater 50 at an oil inlet 52', which may be separate from heater treater inlet 52 that receives stabilizer tower oil output stream 142.

Gas that is pressurized to a desired pressure in VRU 60 is discharged at a gas outlet 61 to yield a VRU gas output stream 164*a* that go be piped to an end user, accumulated with other gas streams, such as separator output gas stream 134, and/or gas streams from other sources.

Heater treater 50 is illustrated in FIG. 2B as a horizontal heater treater. Heater treater 50 includes an inlet 52 for receiving stabilizer oil output stream 142, which typically is an emulsion of water, oil, and gas at approximately the stabilizer tower pressure. Heater treater 50 may include an oil dump valve, a gas back-pressure valve, a water dump valve and like process equipment and its instrumentation, as will be understood by persons familiar with heater treater technology in view of the information herein. Heater treater 50 may be of any type, such as vertical or horizontal, and may include combination of valves and their actuation, such as mechanical and pneumatic actuation. Chemical agents may be used to weaken the emulsifying agents, depending on the chemistry of the fluid in the heater treater, the process conditions, and the desired output properties.

Heater treater 50 also includes a burner system 58 that typically includes a burner, a fire tube, a burner management system, and a stack. The burner management system includes a thermostat, a gas burner valve, and a safety system for controlling temperature in the process, such as fluid temperature within heater treater 50. The fire tube is an indirect-type heat exchanger within heater treater 50 that transfers heat to the process fluid. The products of combustion exit the fire tube through the stack.

Thus, after initial degassing in the inlet portion of heater treater 50 near inlet 52, heat from the fire tube is transferred to the process fluid within heater treater 50, which raises the process temperature to (typically) 100 to 160 degrees F. Heating the emulsion in this regard decreases fluid viscosity, enhances the separation of water from the oil, and promotes gas release. Gas from the initial degassing and gas stripped from the emulsion via heating can be combined to yield a heater treater gas output stream 154, which is also referred to herein as third gas stream 154. As explained more fully below, gas output stream 154 is circulated back to recirculation gas inlet 82 of stabilizer tower 40 from a gas outlet 55 of heater treater 50.

Processing within heater treater 50 yields a stabilized oil output stream 152*a* at an oil outlet 53 and a water output stream at water outlet 57. Stabilized oil output stream 152*a* is at a temperature and pressure that enables it to be sent to and stored in a stabilized crude oil tank 70 that is at atmospheric pressure.

A portion, referred to herein as the oil recirculation stream 152*b* and the third oil stream 152*b*, of the oil output from heater treater 50 is recirculated from heater treater oil output 53 to oil inlet 52' where preferably it is combined with VRU oil output stream 162. As referred to above, the recirculation system 80 includes the oil recirculation stream 152*b*. A pump 59 (shown in FIG. 2B) moves oil recirculation stream 152*b* from heater treater oil outlet 53 to the second heater treater oil inlet 52'. Recirculation of oil via oil recirculation stream 152*b* is believed to enhance the conditioning process by increasing the volume of oil that is subject to treatment in heater treater 50.

Recirculation system 80 also includes gas recirculation stream 154 that is piped from heater treater gas outlet 55 to a stabilizer recirculation gas inlet 82. Typically, heater treater pressure is greater than stabilizer tower pressure, such that gas recirculation stream 154 is moved via the pressure difference without requiring additional components, such as a compressor. Typical pressures in the stabilizer tower 40 and heater treater 50 typically are between 5 and 150 PSI (0.4 and 10.4 bars), according to the desired operating conditions.

The inventors have demonstrated that oil stabilization system 10 and the associated process enhances the volumetric flow rate of stabilized oil stream 152*a*. It is surmised that low pressure gas stream 154 from the heater treater flowing upwardly in stabilizer tower 40 in close contact with the oil emulsion dissolves or entrains gaseous hydrocarbons in the liquid stream, even while partial fractionation or distillation of the oil occurs in stabilizer tower 40 at typical stabilizer process conditions, such as 50 to 200 PSIG (3.4 to 14 bars), while retaining pentane and other higher hydrocarbons (such as C5+). Accordingly, it is believed that that fuel heating value and commercial value of stabilized oil stream 152*a* is not unduly adversely affected.

To illustrate a second example of system for conditioning crude oil, a system 210 for conditioning (stabilizing) live crude oil includes separators 230*a*, 230*b*, and 230*c*, a stabilizer such as a stabilizer tower 240, a heater treater 250, a vapor recovery unit and scrubber 260, a stabilized oil tank 270, and an oil and gas recirculation system 280. Each of the components of system 210—including separators 230*a-c*, stabilizer 240, heater treater 250, components of vapor recovery unit and 260, and recirculation system 280—have a structure and function as generally described with respect to corresponding components of first embodiment conditioning system 10. System 210 further comprises sales gas scrubber 264, artificial well gas lift compressor 262, VRU discharge gas scrubber 268, flare gas knockout 295 and 293, water storage tank 273, a high and medium pressure flare 291, and tank vent gas combustor 292.

As illustrated in FIG. 3A, each of three wellheads 220*a*, 220*b*, and 220*c* provide live crude to a corresponding separator 230*a*, 230*b*, and 230*c* (respectively). In embodiment of FIG. 3A, as set out in Table 1, the total live oil feed 222 to the three separators 230*a*, 230*b*, and 230*c* from the wellheads includes 3,450 BPD of oil and 6,000 MSCFD of gas. The live oil feeds in the embodiment of FIG. 3A has a pressure of 180 PSIG (12.4 bars) and a temperature of 90 degrees F. The outlets from 230*a*, 230*b*, and 230*c* are illustrated as oil stream 322, separator outlet gas stream 324, and separator outlet water stream 326. Oil stream 322 is at 90 degrees F. and has a pressure of 20 PSIG (1.4 bar), as the separator process results in a pressure decrease. Separators 230*a*, 230*b*, and 230*b* in FIG. 3A preferably are conventional horizontal, three-phase separators.

TABLE 1

STABILIZER TOWER TO HEATER TO TANKS
TABLE 1 (IN REFERNCE TO FIG. 3A)

| | STREAM/EQUIPMENT | | | | | | | |
|---|---|---|---|---|---|---|---|---|
| | WELLHEAD OUTPUT | 322 | 352a | 326 | 369a | 362 | 344 | 371 |
| | Item | | | | | | | |
| | 1 INLET TOTAL FACILITY | 2 STAB OIL INLET | 3 STAB OIL OUTLET | 4 TOTAL WATER TO TANKS | 5 TOTAL GAS TO USER | 6 GAS LIFT TO 3 WELLS | 7 STAB OVERHEAD GAS | 8 OIL TANK FLASH GAS |
| BPD OIL | 3,450 | 3,445 | 3,406 | — | — | — | — | — |
| BPD WATER | 6,900 | 3 | — | 6,897 | — | — | — | — |
| MSCFD | 6,000 | 237 | 220 | — | 6,157 | 1,800 | 298 | 9 |
| TEMP. F. | 90 | 90 | 140 | 119 | 90 | 120 | 87 | 110 |
| PRES. psig | 180 | 20 | 6 | 17 | 175 | 1,200 | 5 | 1 |

| | STREAM/EQUIPMENT | | | | | |
|---|---|---|---|---|---|---|
| | 359 | 364a&b | 291 | 292 | 353 | 357 |
| | Item | | | | | |
| | 9 RECYCLE OIL TO STAB | 10 LIQUIDS TO STAB | 11 HP FLARE DESIGN GAS | 12 LP FLARE DESIGN GAS | 13 OIL DELIVERY TO LACT | 14 WATER DELIVERY TO GATHERING |
| BPD OIL | 5,000 | 22 | — | — | 3,260 | — |
| BPD WATER | — | — | — | — | — | 6,897 |
| MSCFD | — | — | 12,500 | 6,290 | — | — |
| TEMP. F. | 100 | 86 | 120 | 120 | — | — |
| PRES. psig | 20 | 25 | 100 | 1 | — | — |

Stabilizer tower 240 yields a stabilizer oil output stream 342 and a stabilizer gas outlet stream 340*a* at 87 degrees F. and 5 PSIG (0.4 bar). As described more fully below, stabilizer tower 240 includes an inlet 282 for receiving a heater treater gas output stream 280*a*. As illustrated in dashed line, heat treater gas output stream 354' may provide a bypass or a partial bypass around stabilizer 240 for all or a portion of gas stream 354. Gas stream 354' or stabilizer tower 240 output gas stream 344 may bypass VRU 260 by flowing all or a portion of gas streams 354' and 344 to flare gas knockout 295. Flare gas knockout 295 yields a condensate output stream 396 controlled by liquid pump 296 and a gas output stream 395 to flare 291. Condensate stream 396 flows to stabilized oil tank 270. Oil storage tank 270 and water storage tank 273 yield a gas output stream 371 and 372 respectively. Gas streams 371 and 372 flow to flare gas knockout 293. Flare knockout 293 produces a condensate stream 394 that is controlled by liquid pump 294, and combines with condensate stream 396 to flow to oil storage tank 270, and a gas stream 393 that flows to combustor 292. Combustor 292 and flare 291 may be a single flare or combustor or a combination of both or like devices. Water storage tanks produce a water output stream 357 that is controlled by pump 274 to flow water stream 357 to a user.

Vapor recovery unit (VRU) 260 includes a pair of packaged vapor recovery units and a vapor recovery scrubber 10. Condensate stream 364*a* from a gas lift compressor 262 (FIG. 3A) and other process equipment, such as condensate 364*b* from 2-phase separator 264, are fed into stabilizer tower 240. Condensate streams 364*a* and 364*b* in the embodiment shown is 22 BPD at 86 degrees F. and 25 PSIG (1.7 bar). Sales gas scrubber 264 yields a gas outlet stream 369*a* that can go to an end user for further processing or may produce a gas stream 369*b* to gas flare 291. A portion of gas stream 369*a* is sent to gas lift compressor 262 to supply gas stream 362 to wellheads 220*a*, 220*b*, and 220*c* for artificial well lift. VRU 260 yields an outlet stream 363 that is comprised of oil and gases that will feed into a two phase separator 268. Separator 268 yields an oil output stream 362 that recirculate back to heater treater 250. Separator 268 yields a gas output stream 367 that combines with gas stream 324.

Heater treater 250 receives stabilizer oil output stream 342. Heater treater 250 yields a gas output stream 354, which as explained above preferably is inserted into stabilizer tower 240 to form recirculation system 280. Heater treater 250 also yields a heater treater oil output stream 352*a* via an oil pump 253 and a heater treater water output stream 356 via water pump 257. Heater treater oil output stream 352*a* (that is, the stabilized oil output of the system 210) is 3,406 BPD at 140 degrees F. and 6 PSIG (0.41 bar). Stabilized oil output stream 352*a* is moved by oil pump 253 to stabilized oil tank 270. The rate of oil stream 353 from tank 370 (item 13 in Table 1 and FIG. 3A) is a factor of the capability of the Lease Automatic Custody Transfer Unit (LACT) and/or downstream customer limitation.

A portion of the heater treater output, an oil recirculation stream 352*b* may be recirculated from a heater treater oil output to oil inlet of the heater treater 250, as controlled by oil pump 253. A portion of the heater treater water output, a water recirculation stream 353, may also be recirculated from the heater treater 250 water output stream 356, as controlled by water pump 257.

An optional recirculation system 358, including an oil pump 259, may circulate stabilized oil from tank 270 to stabilizer 240, as needed to enhance the temperature, pressure, and/or other variables relating to the system. In the embodiment of FIG. 3A, oil recirculation stream 359 is optional and can yield approximately 5,000 GPD at 100 degrees F. and 20 PSIG (1.4 bar). Oil tank output 353 in the embodiment shown is 3,260 BPD.

In some embodiments, compressed gas stream 1434 from the vapor recovery compressor 1430 will be sent to a gas cooling process 1420 (See e.g., FIG. 1C, FIG. 1D, FIG. 1E, and FIG. 1*f*). Gas cooling can be done typically by a fan and belt cooler and radiator, or sometimes a heat exchanger that will cross exchange hot gas stream 1434 with a cold fluid or gas in attempt to lower gas stream 1434 temperature. Once the desired temperature is reached in gas stream 1434, it will flow into 2-phase separator 1520. By cooling the compressed gas to a desired temperature, it will allow heavy hydrocarbons such as pentanes and other C5+ hydrocarbons to compress into a liquid phase. 2-phase separator 1520 will separate gas from this hydrocarbon rich condensate. The produced gas from 2-phase separator 1520 will be sent to gas sales and the condensate 1634 captured will be returned back to stabilizer tower 1446. Condensate 1634 will enter the bottom of stabilizer tower 1446. When the condensate enters the tower, it will vaporize and rise up the tower to cross exchange with the oil stream coming down the tower in the packaging sections. This will allow the vapor pressure on the hydrocarbon condensate vapor to change and allow the heavy C5+ hydrocarbons to convert into a liquid phase. This process will cause an increased volumetric flow of hydrocarbon liquids in the stabilizer tower and will increase the swell created from the stabilizer tower. Some vapor will remain in the gas phase and comingle with gas stream 1334 to be sent to vapor recovery compressor 1430. This will allow a loop of gas to be recycled to the inlet of the vapor recovery compressor and allow the compressor to have more of a constant flow of gas and keep the compressor running instead of shutting down due to lack of inlet pressure and flow.

In some embodiments, the produced oil 1456 from heater treater 1346 will be sent to an oil cooling process 1546 (See e.g., FIG. 1C, FIG. 1D, FIG. 1E, and FIG. 1F). Oil cooling can be done with a fan and belt radiator or a heat exchanger that will cross exchange the hot oil will either a cold gas or liquid to cool oil stream 1456 to a desired temperature. After cooling to a desired temperature, oil stream 1556 will flow into an oil storage tank. Cooling the oil from heater treater 1346 will stabilize the crude oil and stop any gas from separating from oil stream 1556 when it enters a low pressure oil storage tank.

The inventors have demonstrated that oil stabilization process 10 enhances the volumetric flow rate of stabilized oil stream 152*b*. It is surmised that low pressure gas stream 154 from the heater treater flowing upwardly in stabilizer tower 40 in close contact with the oil emulsion dissolves or entrains gaseous hydrocarbons in the liquid stream, even while partial fractionation or distillation of the oil occurs in stabilizer tower 40 at typical stabilizer process conditions (temperature and pressure) while retaining pentane and other higher hydrocarbons (such as C5+). Accordingly, it is believed that that fuel heating value of stabilized oil stream 152*a* is not unduly adversely affected.

In this regard, the following process flow data has been calculated, based on a typical live crude oil stream 122, to compare a prior art stabilization system to the stabilization method of system 10.

TABLE 2

STABILIZER TOWER TO HEATER TO TANKS

| | Wellhead Output | Prior Art Output | System 10 Output | Change |
|---|---|---|---|---|
| Oil BOPD | 6703 | 6,566 | 6,684 | +1.8% |
| Oil Output Loss BOPD | 0 | −137 | −19 | 118 |
| RVP PSIG | | 10 | 8 | 25% |
| Gas MMscfd | 17.89 | 18.29 | 18.17 | −0.70% |
| Water BWPD | 14,510 | 14,510 | 14,510 | — |

The prior art stabilization system in the second data column above is based on a conventional stabilizer model employing a first stage separator operating at 150 PSIG (10.3 bars), a heater treater operating at 50 PSIG and 120 degrees F., and a vapor recovery tower operating at 5 PSIG (0.4 bar). The data for stabilizer system 10 Output in the third data column above is based on a first stage separator 30 operating at 150 PSIG (10.3 bars), a stabilizer tower 40 operating at 6 PSIG, and a heater treater operating at 6 PSIG (0.41 bars) and 140 degrees F. The higher output temperature of gas stream 154 from the heater treater 50 flowing into stabilizer 40 is believed to enhance the conditioning process.

In this regard, the inventors understood that recirculation systems 80 and 280, including gas streams 154 and 354 of system 10 and system 210, enhances the stabilization process by (among other things) increasing the temperature in stabilizer tower 40 or 240 by introducing gas stream 154 or 354 from heater treater 50 or 250. The inventors surmise that the increased temperature within tower 40 improves separation and retention of higher hydrocarbons (such as C5+) into the oil stream.

The first row of Table 2 provides the oil output of the conventional stabilizer system and oil output of system 10 described herein—showing an improvement of in oil output per day of system 10 relative to the conventional stabilizer system. The second row of Table 20 provides the volumetric loss of oil from the available oil in the live crude from the first row. As shown, system 10 yields 118 more barrels per day more than the conventional stabilizer system, which is an improvement of approximately 1.8%. The units of Table 2 are million standard cubic feet of gas, barrels of oil per day, and barrels of water per day.

The fourth row of Table 2 provides the gas output of the conventional stabilizer system and the gas output of system 10—showing a decrease or "shrink" is gas production. In this regard, Table 2 reflects an increase in the volumetric flow rate of oil (that is, oil swell or uplift measured by stabilized oil stream 152*a*) that is greater benefit than decrease in volumetric flow rate of the gas (that is, the sum of separator gas output stream 134 and VRU gas output stream 164). Further, because of typical pricing structures in the oil and gas industry, a unit increase in stabilized oil production would outweigh a decrease in gas production of the same percentage magnitude. Thus, even if the magnitude of the percentage changes in were equal, system 10 would enhance the stabilization process compared with the conventional system.

The third row of Table 2 provides the Reid Vapor Pressure (RVP) of the oil output. RVP is a property of the fuel at standard conditions—absolute vapor pressure exerted by the vapor of a liquid and any dissolved gases at 100 degrees F., according to test method ASTM-D323. Thus, RVP is a measure of the inherent volatility of the stabilized oil stream 152*a* and correlates to losses of the gas output to the atmosphere. As reported in Table 2, RVP of the gas output from the conventional stabilizing system is reduced from 10 PSIG (0.7 bars to 8 PSIG (0.55 bars) by employing stabilizer system 10.

Fugitive emissions include leaks and other irregular releases of vapors or gasses from a pressurized processes, equipment, valves and piping, and the like. It is believed that the magnitude of fugitive emissions of hydrocarbons is related to pressure. Accordingly, the decrease in RVP, reflecting a decrease is actual pressure, of system 10 compared with that of the prior art (illustrated in Table 2) corresponds and illustrates a decrease in fugitive emissions of conditioning system 10.

Heater to Stabilizer Tower to End User

To illustrate a third example, FIG. 5A depicts one implementation of a system 300 and FIG. 5B depicts another implementation of a system 310 for conditioning (stabilizing) live crude oil that enables an operator to selectively bypass the oil storage tanks 270 and instead route the stabilized oil directly to oil sales 353 using a LACT unit 271.

In more detail, FIG. 5A shows an implementation of a system 300 for reducing emissions. This system 300 includes using existing equipment, such as a 3-phase heated separator 250 and a vapor recovery tower 1746. In this process, the inlet valve 276 to the oil storage tank 270 may be closed so that the vapor recovery tower oil outlet stream 342 may be routed directly to oil sales 353 using a LACT unit 271. Because the vapor recovery oil outlet stream 342 bypasses the oil storage tank 270, this process eliminates the chance of producing fugitive emissions within the oil storage tank 270. In some implementations, the combination of operating the vapor recovery tower 1746 at low pressure and bypassing the oil storage tank 270 can further decrease emissions.

FIG. 5B shows another implementation of a system 310 for reducing emissions. This system 310 is similar to the system 300 shown in FIG. 5A, except it uses an oil stabilizer tower 240 instead of a vapor recovery tower 1746 and further includes a two-phase oil storage vessel 275 through which the oil stabilizer tower oil outlet stream 342 may be routed to bypass the oil storage tank 270. Thus, the LACT unit 271 can receive the oil outlet stream 344 from the oil storage vessel 275 and send it directly to oil sales 353. Like the system 300 shown in FIG. 5A, the oil storage tank 270 is bypassed to eliminate fugitive emissions that are typically produced in oil storage tanks.

FIG. 6 (Prior Art) shows a simple diagram of a production facility. This production facility is similar to the system shown in FIG. 1B, except FIG. 6 depicts that an oil outlet stream 1656 can be drawn from the stabilized crude oil storage tank 1646 and sent to an end user.

Heater to Vapor and Liquid Recovery Tower to Tanks or End User

To illustrate a fourth example, FIG. 6A depicts one implementation of a system 1000 and FIG. 6B depicts another implementation of a system 1010 for conditioning (stabilizing) live crude oil that enables an operator to selectively rely upon gravity to flow third oil stream 152*a* to the inlet of the stabilized crude oil storage tank 70.

In more detail, FIG. 6A shows an implementation of a system 1000 that is similar to the systems shown in FIG. 1D, FIG. 2D, FIG. 3B and FIG. 4D except the stabilizer tower 40 used in system 1000 may be a vapor and liquid recovery tower (VLRT) as further described herein, and system 1000 may rely on gravity to flow third oil stream 152*a* to the inlet of the stabilized crude oil storage tank 70. In addition, oil cooling is removed from this system 1000. A fourth oil stream 163 may be transferred with the use of pressure from the VRU 60 to the heater treater 50. Oil recirculating and transfer pump 52 may optionally be included to transfer recirculating oil stream 152*b* to the inlet of stabilizer tower 40 and/or to transfer third oil stream 152*a* to the oil storage tank 70.

FIG. 6B shows another implementation of a system 1010 that is similar to the system shown in FIG. 6A but includes the use of control valves and with different operating pressures and temperatures throughout the process.

FIG. 6C shows another implementation of a system 1020 that is similar to the systems shown in FIG. 6A except it includes a second stabilizer tower 41, and the second stabilizer tower 41 used in system 1020 may be a vapor and liquid recovery tower (VLRT). The second VLRT 41 may receive first water stream 138 from the separator 30 and/or second water stream 148 from the heater 50 to produce fifth gas stream 184 that routes to the VRU 60, fifth oil stream 182 that gravity flows to the stabilized crude oil storage tank 70, and third water stream 183 that gravity flows to a stabilized water storage tank 71.

FIG. 6D shows an isometric view of a VLRT, as well as inlet lines for streams flowing into the VLRT and outlet lines for streams flowing out of the VLRT. When the VLRT is operating in the position of the first stabilizer tower 40 shown in FIG. 6A, FIG. 6B, and FIG. 6C, a first oil inlet line 402 to the VLRT will receive a produced oil stream, such as second oil stream 142*a* from heater treater 50, or alternatively, a produced oil stream from a crude oil/gas separation stage. The second oil stream 142*a* will enter the top section of the VLRT and the oil will flow via gravity down through the VLRT. An oil outlet line 404 of the VLRT will receive processed third oil stream 152*a* that may gravity feed without the use of a pump into one or more oil storage tanks 70 for holding. In one implementation, the oil outlet line 404 will be set to keep a minimum fluid level and will have a spill over outlet for third oil stream 152*a* to flow to the top of an oil storage tank 70. The third oil stream 152*a* that enters oil storage tank 70 will be considered a stabilized oil stream such that the oil will have a reduced level of gas emissions while it is retained in the holding tank.

A gas inlet line 406 to the VLRT will receive a produced gas stream, such as second gas stream 154*a* from heater treater 50, or alternatively, a produced gas stream from a crude oil/gas separation stage. The second gas stream 154*a* will enter the VLRT in a lower section and rise up through the VLRT. A gas outlet line 408 of the VLRT will receive processed third gas stream 144*a* that flows to the inlet of the VRU 60 where the gas will be compressed and cooled. In some implementations, the gas will be cooled using an air-cooled fan cooler.

As depicted in FIG. 6B, the compression and cooling process in the VRU 60 will produce a combined liquid and gas stream 151 that will be processed through a 2-phase separator 68 to produce separate liquid and gas streams.

The liquid stream produced from the separator 68 is referred to in FIG. 6A, FIG. 6B and FIG. 6C as the fourth oil stream 163. The liquid recovery process in the separator 68 will recover the light hydrocarbons, such as ethane, butane, and propane in the fourth oil stream 163, which will be sent back to the heater treater 50. Part of this fourth oil stream 163 will vaporize in the heater treater 50, but will mix with the vapor stream inside the heater treater 50. The vapor density of the condensate within the heater treater 50 will thereby get heavy enough to produce liquid droplets in the gas phase that drop out and mix with the liquid phase. The remaining vapors will proceed to the outlet of the heater treater 50 as the second gas stream 154*a* to enter the gas inlet line 406 to the VLRT. The heater treater 50 provides a stable temperature of gas and liquid to be sent to the stabilizer tower.

The gas stream 164*a* from the separator 68 is routed to the end user, but a recirculating gas stream 164*b* may be pulled from the gas stream 164*a* for return to the heater treater 50 as shown in FIG. 6A, FIG. 6B and FIG. 6C. Alternatively, the recirculating gas stream 164*b* may be returned to the VLRT. This recirculating gas stream 164*b* may be added to the VLRT to maintain a desired oil to gas ratio inside the packing sections of the VLRT, which are depicted in FIG. 6E and described in more detail with respect to that drawing.

In some implementations, an oil recirculation and transfer pump 52 may be installed on the bottom of the VLRT to recirculate oil stream 152*b*, which is a portion of third oil stream 152*a* output from the VLRT, back to the top of the VLRT through a second oil inlet 403. The pump 52 may also transfer third oil stream 152*a* to the oil storage tank 70.

The VLRT may include a spill over or flush out system to control a flooding situation in the top of the VLRT. If fluid starts to rise in the top section of the VLRT, an oil stream will be able to bypass the middle section of the VLRT and flow into the bottom section of the VLRT.

In some implementations of the systems 1000, 1010, 1020, second oil stream 142*a* and/or second gas stream 154*a* may optionally be routed to bypass the VLRT (stabilizer tower 40) in case of an upset. In addition, the combined third gas stream 144*a* may optionally be routed to bypass the VRU 60 in case the compressor is not operational or shuts down.

FIG. 6E shows a side cross-sectional view of an upper portion of the VLRT, which includes a top packing section 430 and a bottom packing section 435. In some implementations, each packing section 430, 435 is approximately 4 feet tall. Each packing section 430, 435 may include a top coalescing baffle 431 and a bottom coalescing baffle 432. These baffles 431, 432 include holes so fluid can pass through, and in some implementations, the holes are approximately 0.5 inch in diameter. Between the top baffle 431 and bottom baffle 432 in each packing section 430, 435 a packing material is employed to spread the oil stream out and increase contact surface area with the gas stream inside the VLRT. In some implementations, the packing material comprises 1 inch nominal diameter T-pac polypropylene random packing balls.

As one of ordinary skill in the art will understand, the design of the upper portion of the VLRT may vary. In some implementations, packing trays may be used instead of coalescing baffles, pall rings may be used instead of random packing, the type of packing material may be altered, the height of the packing sections may be modified, the number of packing sections can vary, the dimensions of the baffle holes can change, the sizes of the packing material can be modified. Other design modifications are within the scope of the present disclosure.

In operation, the second oil stream 142*a* will flow into the VLRT through first oil inlet 402 and flow downwardly through the packing sections 430, 435. Likewise, the second gas stream 154*a* will flow into the VLRT through the gas inlet 406 and rise upwardly through the packing sections 430, 435. In some implementations, when the second gas stream 154*a* flows into the bottom section of the VLRT, a displacement nozzle 440 is employed to disperse the gas stream evenly in the VLRT before it flows through the packing sections 430, 435. In some implementations, the displacement nozzle 440 comprises a pipe with holes drilled into the bottom of the pipe. The pipe may have a 4 inch nominal diameter and the drilled holes may be approximately 0.5 inches in diameter.

Within the packing sections 430, 435, the gas stream and the oil stream will cross-exchange such that the gas stream comes in contact with the oil stream. At a certain pressure and temperature ranges, heavy and light hydrocarbons (ethane through decane) molecules will be added to the oil stream such that the third oil stream 152*a* exiting the VLRT has a larger volume than the second oil stream 142*a* that enters the VLRT, and the combined third gas stream 144*a* exiting the VLRT has a smaller volume than the second gas stream 154*a* that enters the VLRT. In some implementations, the VLRT operates in a pressure range of approximately 0 psig to approximately 20 psig and a temperature range of approximately 100 degrees Fahrenheit to approximately 150 degrees Fahrenheit. The temperature and the pressure settings in the VLRT can be modified to alter the Reid Vapor Pressure (RVP) of the gas stream 144*a* and the American Petroleum Institute (API) properties of the oil stream 152*a* exiting the VLRT to meet the acceptance criteria of the end user.

FIG. 6F shows an isometric view of a representative partial system 1000, 1010 that includes the VRU 60, the VLRT, and a plurality of storage tanks 70. FIG. 6G shows an isometric view of the representative partial system 1000, 1010, 1020 of FIG. 6F from a different vantage point, rotated approximately 180 degrees from the view of the system 1000, 1010, 1020 shown in FIG. 6F. As previously discussed, the VLRT receives the second oil stream 142*a* from the heater treater 50 and the second gas stream 154*a* from the heater treater 50 to produce third oil stream 152*a*. As best shown in FIG. 6G, the third oil stream 152*a* can be routed directly to one of the oil storage tanks 70, or the third oil stream 152*a* can become a bypass stream 152*d* that bypasses the oil storage tanks 70 to be routed to a liquid transfer pump 71 shown in FIG. 6B. A plurality of lines may be coupled to the tops of the oil storage tanks to carry gas stream 179 to vent or to a flare to be burned and released.

As previously described, the VLRT is designed to cross exchange an oil stream and a gas stream through a packing section that is configured to substantially maximize surface area contact between the oil stream and the gas stream. This process reduces fugitive emissions from the oil stream and recovers hydrocarbons that are typically carried with the gas stream, thereby producing a higher volume yield in the oil stream.

The VLRT may also be adapted for receiving a water stream consisting of a water and oil and gas emulsion instead of only an oil and gas emulsion stream. In this configuration, the VLRT and may produce a gas outlet stream, and both an oil outlet stream and a water outlet stream. This VLRT design can also be used to separate oil and gas out of a water inlet stream. In this case, the heater treater output gas stream will bypass the VLRT. Both the oil and water output stream will be gravity fed to an oil or water storage tank or to oil or water liquid transfer pumps. The VLRT may be used to extract gas from an oil stream or extract gas or gas and oil from a water stream.

The VLRT design does not require the addition of energy to transfer the oil stream and gas stream through the equipment. Instead, the VLRT is operable to gravity feed the third oil stream 152*a* either to a storage tank 70 or to a bypass stream 152*d* that feeds the suction line of a liquid transfer pump 71, all while reducing fugitive emissions and recovering hydrocarbons.

In this regard, Table 3 below summarizes process flow data that has been calculated, based on a typical wellhead output, to compare the oil, gas, and water outputs of a prior art VRT to the oil, gas, and water outputs of the VLRT when the oil stream output is routed to an oil tank for storage before reaching an end user.

TABLE 3

HEATER TO VAPOR AND LIQUID RECOVERY TOWER TO OIL TANK TO END USER

| | Wellhead Output | Prior Art Output (VRT) | New VLRT Output | Change |
|---|---|---|---|---|
| Oil BOPD | 7,800 | 7,032 | 7,171 | +1.97% |
| Oil Output Loss BOPD | 0 | −768 | −629 | +139 |
| RVP PSIG | — | 8.15 | 9.19 | +1.04 |
| API | — | 51.56 | 51.98 | +0.42 |
| Gas MMscfd | 11.00 | 12.40 | 12.19 | −1.69% |
| Water BWPD | 13,000 | 13,000 | 13,000 | — |

Similarly, Table 4 below summarizes process flow data that has been calculated, based on a typical wellhead output, to compare the oil, gas, and water outputs of a prior art VRT to the oil, gas, and water outputs of the VLRT 400 when the oil stream output is routed directly to a liquid transfer pump, bypassing storage in oil tanks.

TABLE 4

VAPOR AND LIQUID RECOVERY TOWER TO TRANSFER PUMP (NO OIL TANKS)

| | Wellhead Output | Prior Art Output (VRT) | New VLRT Output | Change |
|---|---|---|---|---|
| Oil BOPD | 7,800 | 7,032 | 7,201 | +2.40% |
| Oil Output Loss BOPD | 0 | −768 | −599 | +169 |
| RVP PSIG | — | 8.15 | 9.51 | +1.36 |
| API | — | 51.56 | 52.16 | +0.60 |
| Gas MMscfd | 11.00 | 12.40 | 12.19 | −1.69% |
| Water BWPD | 13,000 | 13,000 | 13,000 | — |

Table 5 below summarizes inlet and outlet conditions that have been calculated, based on a typical wellhead output with typical temperatures and pressures, for a system that includes the VLRT 400. Table 5 shows how similar operating temperatures and pressures have different oil volumetric output for VLRT.

TABLE 5

OPERATING CONDITIONS FOR VLRT INPUTS AND OUTPUTS

| Vapor and Liquid Recovery Tower (VLRT) | | Wellhead Emulsion | | | 3-phase separator | Heater Treater |
|---|---|---|---|---|---|---|
| | | Oil | Gas | Water | | |
| Temperature | F. | 100 | 100 | 100 | 97.28 | 140 |
| Pressure | psia | 134.7 | 134.7 | 134.7 | 122.8 | 64.7 |
| Liq Vol Flow @Std Cond | barrel/day | 7800 | — | 13000 | — | — |
| Std Gas Flow | MSCFD | — | 11,000 | — | — | — |

TABLE 5-continued

| OPERATING CONDITIONS FOR VLRT INPUTS AND OUTPUTS | | | | | | |
|---|---|---|---|---|---|---|
| Vapor and Liquid Recovery Tower (VLRT) | | Vapor and Liquid Recovery Tower | Oil Tank Vent Gas Outlet | Oil Tank Oil Outlet | Total Gas to End User | VLRT Oil Outlet to Transfer Pump |
| Temperature | F. | 132.9 | 105 | 105 | 96.27 | 116 |
| Pressure | psia | 15.7 | 14.67 | 14.67 | 115.9 | 15.7 |
| Liq Vol Flow @Std Cond | barrel/day | — | — | 7170.64 | — | 7201.14 |
| Std Gas Flow | MSCFD | — | 1.4 | — | 12.19 | — |

Table 6 below summarizes inlet and outlet conditions that have been calculated, based on a typical wellhead output with typical temperatures and pressures, for a system that includes a prior art Vapor Recovery Tower (VRT).

TABLE 6

| OPERATION CONDITIONS FOR VRT INPUTS AND OUTPUTS | | | | | | |
|---|---|---|---|---|---|---|
| Vapor Recovery Tower (Prior Art) | | Wellhead Emulsion | | | 3-phase separator | Heater Treater |
| | | Oil | Gas | Water | | |
| Temperature | F. | 100 | 100 | 100 | 97.28 | 140 |
| Pressure | psia | 134.7 | 134.7 | 134.7 | 122.8 | 64.7 |
| Liq Vol Flow @Std Cond | barrel/day | 7800 | — | 13000 | — | — |
| Std Gas Flow | MSCFD | — | 11,000 | — | — | — |

| Vapor Recovery Tower (Prior Art) | | Vapor Recovery Tower | Oil Tank Vent Gas Outlet | Oil Tank Oil Outlet | Total Gas to End User |
|---|---|---|---|---|---|
| Temperature | F. | 122.4 | 105 | 105 | 96.27 |
| Pressure | psia | 15.7 | 14.67 | 14.67 | 115.9 |
| Liq Vol Flow @Std Cond | barrel/day | — | — | 7031.86 | — |
| Std Gas Flow | MSCFD | — | 10.1 | — | 12.40 |

A comparison between Table 5 and Table 6 shows how similar operating temperatures and pressures produce different oil volumetric output for VLRT.

The systems and processes described herein refer to process flows from and to components, and/or that a component receives or is adapted to receive a process flow from another component. In this regard, these process flow terms encompass flow directly from the first specified component to the second specified component without major process equipment in between, but including piping, valves, pressure relief devices, safety and monitoring devices, instrumentation, and the like as needed. The description is not limited by prohibiting major process equipment or processes between the first specified component to the second specified component, as it is understood that components, sub-systems, and processes may be added between any of the components (such as wellhead 20 or 220*a-c*, separator 30 or 230, stabilizer tower 40 or 240, heater treater 50 or 250, VRU 60 or 260, tank 70 or 270, vapor recovery tower 1746, VLRT 400), and that the components can be modified in many ways, consistent with the broad conception of the invention and defined in the claims.

The process data provided herein is design data; actual operating data may vary according to change in condition and/or desired output and the like, as will be understood by persons familiar with oil and gas processing technology. Further, the process data provided in the specification is or are examples which are not intended to limit the scope of the invention.

The description herein describes particular examples of components, systems, and processes. The present invention is not limited to the particular components, systems, and processes specified herein. Rather, it is intended that the scope of the present invention be measured by the claims, without viewing any components, systems, or processes of the specification as essential. It is also understood that a person familiar with crude oil stabilization technology would understand that many terms used herein have established meaning that is specific to the oil and gas industry and/or oil stabilization technology, and that the terms inherently include many details that are not necessary to recite.

Further, the information in the Background section describes conventional oil stabilization technology and components. It is not intended to disclaim any subject matter for any component, sub-system, or system, as the preferred embodiments described in the specification incorporate aspects of the conventional technology.

EXAMPLES

The following examples are provided to further describe some of the implementations disclosed herein. These examples are intended to illustrate, not to limit, the disclosed implementations.

FIG. 3C shows an exemplary 3-well production facility but is not limited to the number of wells used in a facility design. Each well head, 220*a*, 200*b*,220*c* will flow an emulsion fluid, a mixture of oil, gas, and water, to a 3-phase separator 230*a*, 230*b*, 230*c* respectively, for the first stage of processing and separation. The 3-phase separator will separate the inlet emulsion into oil, gas, and water using gravity and retention time. Produced water from each 3-phase separator will comingle and will flow into water storage tanks. Typically a gun barrel 272 is used to catch any oil that is carried over into the water stream. Water from gun barrel 272 is gravity fed into the water storage tank 273. Oil produced in gun barrel 272 is gravity fed into the oil storage tank 270. Water in the water tank 273 is pumped with pump 274 to a salt water disposal facility.

Gas produced in 3-phase separator 230*a*, 230*b*, and 230*c* will comingle gas streams and flow in gas stream 334 to a 2-phase separator 264. This 2-phase separator will capture any liquids and produced condensate from the gas stream. Condensate from 2-phase separator 264 will flow into the produced oil stream 322*a* from the 3-phase separators. Gas leaving 2-phase separator 264 will be sent to sales to be purchased from the midstream purchaser in stream 369*a*. If the midstream purchaser cannot accept the gas or if there is an issue sending gas down sales line, a back pressure valve holding pressure will open and send the gas down stream 369*b* to be combusted using a flare.

A desired amount of gas off stream 369*a* will be sent to a gas compressor 262 that sometimes is used for artificial well head lift. This process involved sending high pressure gas down the tubing of a well head to add pressure downhole to supply force for fluids to rise up the well and enter the 3-phase separator. When gas on the compressor 262 is compressed, condensate is separated and from the gas stream and sent down condensate stream 364*a* to comingle with the oil stream 322*a*.

Oil produced from 3-phase separator 230*a*, 230*b*, and 230*c* will be comingled and sent to the maze process through oil stream 322*a*. The maze process used in this example is similar to the process described in FIG. 1C and FIG. 2D. Oil stream 322*a* will enter the stabilizer tower 240 that is equalized in pressure with heater treater 250. There can be a bypass around the stabilizer tower for oil stream 322*a* to enter directly to heater treater 250. Oil flows down the stabilizer tower 240 and gravity feeds into heater treater 250. As oil stabilizes in the stabilizer tower 240, gas is separated from the oil and sent out the top of the tower in gas stream 340*a* to the vapor recovery compressor 260. Vapor recovery compressor 260 typically has an inlet 2-phase separator that will catch any carried over liquids in gas stream 340*a*. This 2-phase separator will typically have a pump of pressurized discharge process for liquids to be transferred. This liquid stream 368*b* will be sent back to the oil stabilizer tower 240.

Gas stream 340*a* will be compressed and sent to a gas cooling process 266 and then to a 2-phase separator 268 to collect condensation from the compression and cooling process. This condensation is sent from 2-phase separator 268 in stream 368*a* to the stabilizer tower to cross exchange with the oil inside the tower. The gas produced from the 2-phase separator 268 will flow in stream 367*a* to comingle with the produced gas stream 334 from the 3-phase separators to be sent to sales. There can be a back pressure valve on stream 367*a* to control the discharge pressure of the vapor recovery compressor 260. Stream 367*b* will be a gas stream that will be sent to the stabilizer tower 240 to maintain a desired gas to oil ratio inside the tower. If the vapor recovery compressor 260 shuts off or cannot handle the flow rate, a back pressure valve will open and send the gas stream 340*b* to a 2-phase separator 295. This 2-phase separator will catch any liquids that are carried over in gas stream 340*b* and send liquids to the oil storage tank 270 using a pump 296. Gas from the 2-phase separator 295 will be sent to flare 291 to be combusted.

Oil from the stabilizer tower 240 is gravity fed into heater treater 250 to be stabilized and process further and get an excess gas and water to be separated from the oil phase. Oil and water pumps are installed to operate a level control process on the heater treater 250. Oil and water will recirculate in the heater treater until a desired height of fluids are reached. When this high water or oil level is reached, the level control process on heater treater 250 will transfer water stream 356 to the gun barrel 272 and oil to the oil cooling process to stabilize the oil further. Once oil stream 352*a* is cooled, oil will be transferred to oil storage tank 270. This oil in stream 352*a* will be stabilized crude and will have zero emissions when it enters and is stored in oil storage tank 270.

Produced gas from the heater treater 250 will free flow into the bottom of the tower in gas stream 280*a* and rise up the stabilizer tower 240 and cross exchange with the oil stream inside the tower. This allows contact point of oil and gas and allows the heavy hydrocarbons the retain in the liquid phase and add extra oil volume and swell to the process. If gas stream 280*a* cannot enter the stabilizer tower 240, a back pressure valve will open up and bypass the tower and send gas stream 280*b* to the vapor recovery compressor 260 or the flare 291 if the vapor recovery compressor is shut off or over ran.

Once oil is sent a stored in the oil storage tank, a Lease Allocation Custody Transfer unit monitors and controls the oil tank fluid level. Once oil fluid levels reach a desired level in oil storage tank 270, the LACT unit measures and transfers oil down stream 353 to the midstream oil purchaser. All storage tanks including the gun barrel 272, water storage tank 273 and oil storage tank 270 have vent lines comingled that transfer the produced gas to a combustor 292. The combustor can also be a typical flare. A back pressure valve is installed on the vent line out to the flare to keep unnecessary flaring from tank in breathing. Tank in breathing is when storage tanks build up pressure solely from filling up with fluids and decreased with SWD pumps or LACT unit pumps drain the fluids from the storage tanks. To prevent flaring when storage tanks fill up with fluids, the back pressure will be set a desired pressure to accommodate the in breathing of tanks and prevent unnecessary gas from being sent to the flare. A flare knock out vessel 293 will capture any carry over fluids off the storage tank vent lines and send any fluids captured back to the oil storage tank 270 using pump 294.

Those skilled in the art will appreciate that numerous changes and modifications can be made to the preferred embodiments disclosed herein and that such changes and modifications can be made without departing from the spirit of the invention. It is, therefore, intended that the appended claims cover all such equivalent variations as fall within the true spirit and scope of the invention.

What is claimed:

1. A system for conditioning a liquid stream comprising:

a vapor and liquid recovery tower (VLRT) comprising:

a top section adapted to receive a liquid stream with entrained gas that gravity flows down through the VLRT; and a packing section comprising packing material adapted to release the entrained gas from the liquid stream to produce a VLRT liquid output and a VLRT gas output;

at least one of an oil storage tank and an oil liquid transfer pump; and at least one of a water storage tank and a water liquid transfer pump;

wherein the liquid stream is a water emulsion, and the VLRT liquid output is a VLRT oil output and a VLRT water output;

wherein the VLRT oil output gravity feeds out of the VLRT and is routed to the oil storage tank or to the oil liquid transfer pump; and wherein the VLRT water output gravity feeds out of the VLRT and is routed to the water storage tank or to the water liquid transfer pump.

2. The system of claim 1, wherein the VLRT further comprises:

a lower section adapted to receive a gas stream that rises up through the packing section;

wherein the packing material is further adapted to increase surface area contact between the liquid stream and the gas stream; and wherein the VLRT gas output comprises the entrained gas and the gas stream.

3. The system of claim 2, wherein the VLRT further comprises:

a displacement nozzle adapted to disperse the gas stream received into the lower section before the gas stream rises up through the packing section.

4. The system of claim 1, wherein the packing material of the VLRT comprises random packing balls or pall rings.

5. The system of claim 4, wherein the VLRT further comprises:

one or more baffles or packing trays adapted to contain the packing material.

6. A system for conditioning a liquid stream comprising:

a vapor and liquid recovery tower (VLRT) comprising:

a top section adapted to receive a liquid stream with entrained gas that gravity flows down through the VLRT; and a packing section comprising packing material adapted to release the entrained gas from the liquid stream to produce a VLRT liquid output and a VLRT gas output;

a lower section adapted to receive a gas stream that rises up through the packing section;

wherein the packing material is further adapted to increase surface area contact between the liquid stream and the gas stream; and wherein the VLRT gas output comprises the entrained gas and the gas stream;

a separator adapted for receiving live crude oil from a wellhead and for producing a separator oil output and a separator gas output; and a heater treater adapted for (i) receiving the separator oil output and (ii) producing a heater treater oil output and the heater treater gas output;

wherein the VLRT is adapted for (i) receiving the heater treater oil output as the liquid stream and receiving the heater treater gas output as the gas stream; and (ii) producing a VLRT oil output as the VLRT liquid output.

7. The system of claim 6, wherein the VLRT gas output has a lower volume than the heater treater gas output and the VLRT oil output has a higher volume than the heater treater oil output.

8. The system of claim 6, wherein:

the VLRT oil output gravity feeds to an oil storage tank or a liquid transfer pump.

9. The system of claim 6, further comprising:

a pump adapted for transferring a recirculating portion of the VLRT oil output back into the VLRT.

10. The system of claim 9, wherein the pump is further adapted for transferring the VLRT oil output to an oil storage tank or to a liquid transfer pump.

11. The system of claim 6, further comprising:

a crude oil storage tank adapted to receive the VLRT oil output for stabilization.

12. The system of claim 6, further comprising:

a liquid transfer pump adapted to (i) receive the VLRT oil output and (ii) provide the VLRT oil output to a user.

13. The system of claim 6, further comprising:

a vapor recovery unit (VRU) adapted for (i) receiving the VLRT gas output and (ii) producing a VRU gas output and a VRU oil output.

14. The system of claim 13, wherein the heater treater is adapted for (i) receiving the VRU oil output and (ii) receiving a recirculating portion of the VRU gas output.

15. The system of claim 13, wherein the separator is adapted for producing a separator gas output and the system is adapted for (i) combining the VRU gas output with the separator gas output and (ii) providing the combined gas output to a user.

* * * * *